US009074325B2

(12) United States Patent
Gehringer et al.

(10) Patent No.: US 9,074,325 B2
(45) Date of Patent: Jul. 7, 2015

(54) PORTABLE TEMPORARY TURNOUT SYSTEM FOR RAILS

(71) Applicant: Union Pacific Railroad Company, Omaha, NE (US)

(72) Inventors: Eric John Gehringer, LaVista, NE (US); Mark Victor Holland, Omaha, NE (US)

(73) Assignee: UNION PACIFIC RAILROAD COMPANY, Omaha, NE (US)

( * ) Notice: Subject to any disclaimer, the term of this patent is extended or adjusted under 35 U.S.C. 154(b) by 132 days.

(21) Appl. No.: 13/830,822

(22) Filed: Mar. 14, 2013

(65) Prior Publication Data

US 2014/0263864 A1 Sep. 18, 2014

(51) Int. Cl.
*E01B 7/00* (2006.01)
*E01B 23/00* (2006.01)

(52) U.S. Cl.
CPC ..... *E01B 7/00* (2013.01); *Y10T 29/49826* (2015.01); *E01B 23/00* (2013.01)

(58) Field of Classification Search
CPC ..... E01B 7/00; E01B 7/02; E01B 7/08; E01B 7/10; E01B 7/16; E01B 7/18; E01B 7/22; E01B 7/28
USPC ..... 246/382–384, 415 R–417, 420–422, 246/432, 454
See application file for complete search history.

(56) References Cited

U.S. PATENT DOCUMENTS

| | | | | |
|---|---|---|---|---|
| 787,711 | A | | 4/1905 | Williams |
| 820,406 | A | | 5/1906 | Flugan, Sr. |
| 824,271 | A | | 6/1906 | Aldrich et al. |
| 899,967 | A | | 9/1908 | Foster |
| 1,131,025 | A | | 3/1915 | Anderson |
| 1,219,794 | A | | 3/1917 | Allen |
| 1,222,577 | A | | 4/1917 | Perkins |
| 1,341,354 | A | | 5/1920 | Booth |
| 3,860,205 | A | | 1/1975 | Dohse |
| 4,005,839 | A | | 2/1977 | Frank |
| 4,005,869 | A | | 2/1977 | Maldonado |
| 4,015,805 | A | | 4/1977 | Friesenbichler |
| 5,354,018 | A | * | 10/1994 | Snead ..... 246/383 |
| 5,456,430 | A | | 10/1995 | Ortiz-Rivas |
| 5,560,571 | A | | 10/1996 | Remington |
| 5,598,993 | A | | 2/1997 | Kuhn et al. |
| 6,758,445 | B2 | | 7/2004 | Click et al. |
| 6,994,299 | B2 | | 2/2006 | Marron |
| 7,261,259 | B2 | | 8/2007 | Little et al. |
| 7,341,226 | B2 | | 3/2008 | Biagiotti et al. |
| 7,377,471 | B1 | | 5/2008 | Compton et al. |
| 7,434,768 | B2 | | 10/2008 | Humphrey et al. |
| 7,604,205 | B2 | | 10/2009 | McCallum |
| 7,740,208 | B2 | | 6/2010 | Mugg |
| 8,424,812 | B1 | | 4/2013 | Voelkerding et al. |
| 8,424,813 | B1 | | 4/2013 | Voelkerding et al. |
| 2011/0011986 | A1 | | 1/2011 | Ossberger et al. |

* cited by examiner

*Primary Examiner* — R. J. McCarry, Jr.

(74) *Attorney, Agent, or Firm* — Pillsbury Winthrop Shaw Pittman, LLP

(57) ABSTRACT

A portable and temporary rail transition system for installation on a main track to guide rail equipment from parallel rails of the main track and onto parallel rails of a turnout track. The system includes rails of turnout track, turnout ties, and rail transition devices that are configured for mounting to the ties and over at least the parallel rails of the turnout track to facilitate guidance of wheels of the rail equipment away from the parallel rails of the main track and onto the parallel rails of the turnout track.

29 Claims, 10 Drawing Sheets

PORTABLE TEMPORARY TURNOUT SYSTEM FOR RAILS

BACKGROUND

1. Field

The present disclosure is generally related to railroad tracks. More specifically, this disclosure is related to a system used to guide rail equipment onto rails of a turnout track.

2. Description of Related Art

In order to transition rail equipment (e.g., locomotives, cars, trains) from a main line track, a turnout track can be installed. A turnout track can be used to guide equipment off of the main line track (e.g., into storage in a rail yard) and/or to redirect movement of the equipment.

The turnout track typically includes parallel rails that curve towards the right or left and are positioned adjacent to tracks of the main line track. Despite their direction of curvature, devices are required to connect the parallel rails of the turnout track to the rails of the main line track so that the equipment being moved is guided onto the parallel turnout rails. As is generally well known, switches can be used to alternately switch between tracks. In other cases, jumpers are used for transition to a turnout track. Bent pieces of rail can be provided over rails of a main line track as a switch point to allow equipment to jump or transition to the turnout track.

Alternatively, braces can be positioned relative to the main line track and, in some cases, placed directly on top of the existing rails of the main line track. That is, rails of a turnout track can be positioned over the rails of a main line, and braced to the existing track. Other devices, called "leap frogs," are designed with a hinge, so that the leap frog can be alternately positioned over at least part of the turnout rails to guide the rail equipment from the main line track and onto the turnout track.

U.S. Pat. Nos. 824,271, 899,967, 1,219,794, 1,222,577, 1,341,354, 4,005,869, 5,354,018, and 7,434,768 B2 show some examples of the devices noted above.

SUMMARY

It is an aspect of this disclosure to provide a portable and temporary rail transition system for guiding rail equipment from parallel rails of a main track to parallel rails of a turnout track. The rail transition system has: ties, a turnout track, and transition devices. A plurality of turnout ties are configured for positioning under the parallel rails of the main track and the parallel rails of the turnout track, and each turnout tie is configured for attachment to at least a portion of the main track and the turnout track. The turnout track includes first and second curved rails configured for positioning adjacent to the rails of the main track in parallel alignment and includes a first transition rail and a second transition rail. The first transition rail has a first end and a second end and is configured for placement between the parallel rails of the main track such that the first end of the first transition rail is adjacent a first rail of the main track and the second end of the first transition rail adjacent a second rail of the main track. The second transition rail is configured for positioning adjacent to an outside of the second rail of the main track and in longitudinal alignment with the second end of the first transition rail. The second curved rail is configured for positioning parallel to the first and second transition rails of the first curved rail adjacent to the outside of the second rail of the main track for curving away therefrom. A first set of rail transition devices is configured for mounting over the parallel rails of the main track and the parallel rails of the turnout track including the first end of the first transition rail and an end of the second curved rail adjacent to the outside of the second rail of the main track. The first set of rail transition devices is configured to guide wheels of the rail equipment away from the parallel rails of the main track. A second set of rail transition device is configured for positioning along the turnout track and spaced longitudinally relative to the first set of rail transition devices for mounting over the turnout track including the second end of the first transition rail and a portion of the second curved rail. The second set of rail transition devices is configured to guide the wheels of the rail equipment onto the parallel rails of the turnout track. Each rail transition device of the first and second sets is configured for attachment to predetermined ties of the plurality of turnout ties when positioned under the main and turnout tracks. Each rail transition device has a guide portion with ramps, with at least one of the ramps configured for alignment with a rail of the turnout track and is configured to guide the wheels of the rail equipment towards and along the parallel rails of the turnout track.

Another aspect provides a method for installing a portable, temporary turnout system to a main railroad track for guiding rail equipment from parallel rails of the main track to parallel rails of a turnout track. The system can include: a plurality of turnout ties configured for positioning under the parallel rails of the main track and the parallel rails of the turnout track, a turnout track having first and second curved rails configured for positioning adjacent to the rails of the main track in parallel alignment, the first curved rail comprising a first transition rail and a second transition rail, and a first set and a second set of rail transition devices. Each rail transition device of the first and second sets is configured for attachment to predetermined ties of the plurality of turnout ties when positioned under the main and turnout tracks. Each rail transition device has a guide portion with ramps and a guard rail. At least one of the ramps of the guide portion is configured for alignment with a rail of the turnout track and configured to guide the wheels of the rail equipment towards and along the parallel rails of the turnout track and the guard rail runs parallel to the guide portion and is spaced therefrom to at least partially receive wheels of the rail equipment to guard from displacement of the wheels from the guide portion and towards the parallel rails of the turnout track. The method includes:

installing the plurality of turnout ties under the parallel rails of the main track;

installing the first curved rail by positioning the first transition rail between the parallel rails of the main track such that a first end of the first transition rail is adjacent a first rail of the main track and the second end of the first transition rail adjacent a second rail of the main track and by positioning the second transition rail adjacent to an outside of the second rail of the main track and in longitudinal alignment with the second end of the first transition rail, the first transition rail and second transition rail being positioned over the installed turnout ties;

installing the second curved rail in parallel alignment with the first and second transition rails of the first curved rail adjacent to the outside of the second rail of the main track for curving away therefrom;

attaching at least a portion of the turnout track to one or more of the installed turnout ties under the parallel rails of the main track and turnout track; and installing each rail transition device of the first and second sets by attaching each rail transition device to predetermined ties of the installed turnout ties and aligning the at least one of the ramps of the guide portion with the rail of the turnout track such that the guard rail is positioned between the installed parallel rails of the turnout track.

Other aspects, features, and advantages of the present disclosure will become apparent from the following detailed description, the accompanying drawings, and the appended claims.

DETAILED DESCRIPTION OF THE PREFERRED EMBODIMENT(S)

Disclosed herein is an engineering system that is configured for temporary installment of a parallel rail to form a turnout track from rails of a main line. Leap frogs or "rail transition devices," as referred to herethroughout, are designed for installation on ends of curved tracks, secured with designed turnout ties, to assist in transitioning equipment to the turnout track. Additional features and advantages are noted throughout the description below. It is noted that, while the Figures illustrate the turnout track being applied to the main track in a generally curved, right to left configuration (i.e., turning towards the left relative to the direction of the main track), one of ordinary skill in the art understands that a similar system (including its parts, e.g., body portion, guide with ramps, etc., as described in further detail below) can be designed and to curve in a left to right configuration (i.e., turning towards the right relative to the direction of the main track) and provided within the same scope of this disclosure.

Figure 1A:
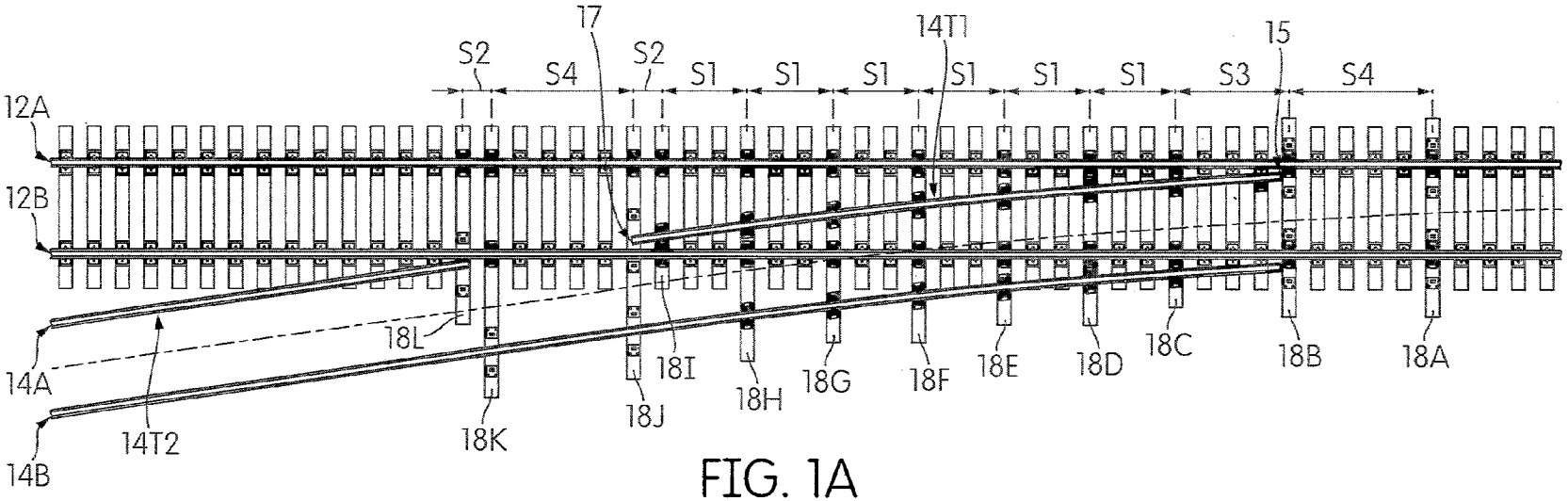
FIG. 1A is an overhead view of a main track and turnout track with installed ties for use with a rail transition system in accordance with an embodiment.

Shown in FIG. 1A is a main track 12 comprising a first rail 12A and a second rail 12B. The first and second rails 12A and 12B are horizontally spaced and run parallel to each other. As is generally known, the rails 12A and 12B are secured in place using spaced ties 16 (e.g., made of wood) to form the main track 12.

A portable and temporary rail transition system 10 is provided herein that is used for guiding rail equipment (e.g., rolling stock, vehicles such as cars, and/or way equipment) from the first and second parallel rails 12A and 12B of main track 12 to first and second parallel rails 14A and 14B of a turnout track 14. The rail transition system includes a plurality of turnout ties 18A-18L that are configured for positioning under the parallel rails 12A and 12B of the main track 12, as well as under rails of the turnout track 14. As illustrated in FIG. 1A, turnout ties 18A-18L are positioned under the parallel rails of the main track 12. The turnout ties 18A-18L can replace pre-installed ties 16 provided under the parallel rails 12A and 12B of the main track 12. That is, the pre-installed ties 16 are removed and replaced with the turnout ties 18A-18L. The turnout ties 18A-18L can be positioned in place of the removed installed ties and spaced relative to pre-installed adjacent ties.

The positions of the plurality of turnout ties 18A-18L under the parallel rails 12A and 12B of the main track 12 and under rails of the turnout track 14 can be predetermined. For example, the placement and spacings S1, S2, S3, etc. between turnout ties 18A-18L are based on the locations and spacing between pre-installed (existing) ties 16 under main track 12. In one embodiment, each of the ties is spaced substantially equidistant to each other. In another embodiment, the spacing of the turnout ties may vary. In an embodiment, the turnout ties between rail transition devices are substantially equally spaced from each other. In another embodiment, the spacing between turnout ties may be based upon the length of the rail transition devices. For example, the relative spacing of turnout ties 18A and 18B and/or turnout ties 18J and 18K may be based on locations (which can be predetermined) for applying attachment devices to and/or along the length of a rail transition device. In one embodiment, the spacing between each of the ties is based on the curve radius of the turnout track 14.

In the embodiment illustrated in FIG. 1A, turnout ties 18C-18D, 18D-18E, 18E-18F, 18G-18H, and 18H-18I are positioned at a space S1 relative to each other. In one embodiment, such as shown in FIG. 1A, each space between the illustrated turnout ties is measured from a centerline of one turnout tie to a center of another, adjacent turnout tie. In another embodiment, each space can be measured between sides of the turnout ties. For explanatory purposes only, the spaces and/or spacings S1-S4 at which turnout ties are positioned relative to one or more adjacent turnout ties are understood herethroughout to mean a measurement taken substantially relative to a center portion of each turnout tie, i.e., from center to center. As shown in FIG. 1A, turnout tie 18J is positioned at a space S2 relative to turnout tie 18I. Turnout tie 18B is positioned at a space S3 relative to turnout tie 18C. Turnout tie 18A is positioned at a space S4 relative to turnout tie 18B. Turnout tie 18K is positioned at a space S4 relative to turnout tie 18J. Turnout tie 18L is positioned at space S2 relative to turnout tie 18K.

In one embodiment, space S1 is approximately 4 feet, 6 inches (inclusive) to approximately 5 feet, 6 inches (inclusive). In another embodiment, space S1 is approximately 4 feet, 9 inches. In one embodiment, space S2 is approximately 16 inches (inclusive) to approximately 24 inches (inclusive). In another embodiment, space S2 is approximately 19 inches. In one embodiment, space S3 is approximately 6 feet to approximately 7 feet. In another embodiment, space S3 is approximately 6 feet, 4 inches. In one embodiment, space S4 is approximately 7 feet (inclusive) to approximately 8 feet, 6 inches (inclusive). In another embodiment, space S4 is approximately 7 feet, 11 inches.

In FIGS. 24-35, an exemplary embodiment of each of the turnout ties 18A, 18B, 18C, 18D, 18E, 18F, 18G, 18H, 18I, 18J, 18K, and 18L for use with the system are illustrated. A length, width, and other features associated with each of the turnout ties is determined based on the turnout track 14 being installed, as well as their intended placement along a length of the main track 12, e.g., in a longitudinal direction. In accordance with one embodiment, the placement of each of the turnout ties in place of the pre-installed ties 16 under the main track is predetermined. That is, the turnout ties can be labeled and/or provided for installation in a predetermined order (e.g., numbered) so that the system is correctly installed and implemented, and so that the ties are configured to align with the rails on both the main track 12 and turnout track 14 when installed.

As shown, each tie 18A-18L can include either attachment plates 22 or turnout plates 20, or both on at a least a top surface thereof. The turnout plates 20 and attachment plates 22 are used to connect with one or more of the rails (e.g., 12A, 12B, 14A, and/or 14B) and/or parts of the rail transition devices 100, 200, 300, and 400. In an embodiment, a combination of two to four turnout plates 20 and/or attachment plates 22 can be provided on each turnout tie. Each of the turnout plates 20 may include a space 24 therein for receiving and securing an object, e.g., a rail, much like attachment plates 22. The space 24 can be positioned a variable distance DT from an end of each tie depending on its placement along the length of the main track 12 and within the system. Each of the turnout plates 22 can be provided an angle relative to the top of the tie itself. Also, as shown, the placement and spacing between the turnout plates 20 and/or attachment plates 22 on top of each of the ties 18A-18L varies depending on the placement of the tie itself. In accordance with an embodiment, the turnout plates 20 and attachment plates 22 are provided on a relative turnout tie based on their intended placement under the main track 12. Thus, the predetermined order of the turnout ties further ensures that the rails of the main track 12 and turnout track 14 can be properly secured.

However, it should be noted that the number of turnout ties 18A-18L is not necessary limited to twelve, as shown in FIGS. 24-35. The number of ties, turnout plates 20, and attachment plates 22, as well as their spacing and length, and dimensions of the ties and plates, can vary and can be altered based on the length and/or curvature of the turnout track 14, for example. Each turnout tie is configured for attachment to at least a portion of the main track and the turnout track thereto, but does not necessarily need to be attached to both rails of either or both tracks 12 and 14. Accordingly, it should be understood to one of ordinary skill in the art that the number and design of each of the turnout ties used to replace pre-installed ties under the main track 12 is not meant to be limiting.

Referring back to FIG. 1A, the turnout track 14 includes first and second curved rails 14A and 14B that configured for positioning adjacent to the rails 12A and 12B of the main track 12 in parallel alignment therewith. More specifically, the first curved rail 14A is formed from a first transition rail 14T1 and a second transition rail 14T2. The first transition rail 14T1 has a first end 15 and a second end 17 and is configured for placement between the parallel rails 12A and 12B of the main track 12 such that the first end 15 is adjacent the first rail 12A of the main track 12 and the second end 17 is adjacent the second rail 12B of the main track 12, as shown. The second transition rail 14T2 is configured for positioning adjacent to an outside of the second rail 12B of the main track 12. The first and second transitional rails 14T1 and 14T2 are parallel to rail 14B and collectively form the curved rail 14A, albeit with a space between the ends of rails 14T1 and 14T2 for rail 12B. The second curved rail 14B is configured for positioning parallel to the first and second transition rails 14T1 and 14T2, respectively, adjacent to the outside of the second rail 12B of the main track 12 for curving away therefrom.

It should be noted that the rails 14A and 14B of the transition track 14 are configured such that when positioned relative to the rails 12A and 12B of the main track 12, there is a gap or clearance between ends of the rails. For example, such a clearance is provided at first end 15 of first transition rail 14T1 relative to (a side of) rail 12A, at second end 17 of first transition rail 14T1 relative to (a side of) rail 12B, an end of second transition rail 14T2 relative to rail 12B, as well as an end of second rail 14B relative to rail 12B. A user can align the rails 14A and 14B such that the gap or clearance is satisfied. The rails 14A and 14B can then be clipped or secured (e.g., using clips or other mechanical devices) along with rails 12A and 12B to the ties to remain in place. The gap or clearance between the adjacent rails allows the rails 12A and 12B and rails 14A and 14B to remain in place even if the rail transition devices 100-400 are not installed, so that train traffic can utilize the rails 12A and 12B of the main track 12. That is, the gap or clearance allows a train to run on the main track 12, since the wheels of the trains can pass between the two existing rails 12A and 12B and the turnout rail 14A and 14B by running through the gaps and between the rails. In an embodiment, the gap or clearance is approximately 5 inches.

In an embodiment, the turnout track 14 has a curve radius of or between approximately five degrees to approximately ten degrees. In one embodiment, the curve radius of the turnout track 14 is approximately nine degrees. The curve radius can be fixed or revised, as needed.

The length of the first transition track 14T1 is based on the curve radius of the turnout track 14. Referring to FIG. 1, for example, assuming the curve radius of the turnout track 14 is designed to be fixed at approximately nine degrees, the length of the first transition track 14T1 is approximately 39 feet.

Figure 1B:
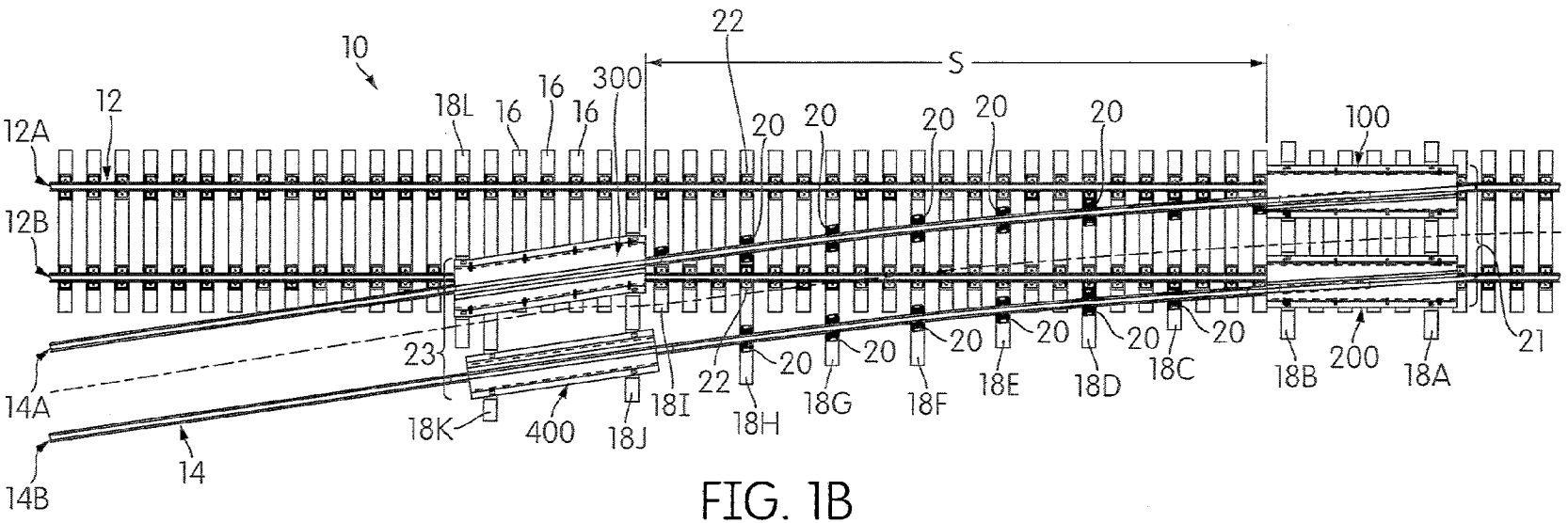
FIG. 1B is an overhead view of an installed rail transition system in accordance with an embodiment.

In addition to the turnout ties 18A-18L and rails of the transition track 14, the rail transition system 10 includes, as shown in FIG. 1B, a first set 21 of rail transition devices 100 and 200 and a second set 23 of rail transition devices 300 and 400. When installed and configured for use, the first set 21 of rail transition devices 100 and 200 is configured to guide wheels of rail equipment away from the parallel rails 12A and 12B of the main track 12 (and towards and onto the parallel rails 14A and 14B of the turnout track 14), and the second set 23 of rail transition devices 300 and 400 is configured to guide wheels of the rail equipment onto the parallel rails 14A and 14B of the turnout track 14.

As shown, the first set 21 is configured for mounting over the parallel rails 12A and 12B of the main track 12 and the parallel rails 14A and 14B of the turnout track 14. Specifically, rail transition device 100 of the first set 21 is configured for mounting over the first end 15 of the first transition rail 14T1. Rail transition device 200 of the first set 21 is configured for mounting over an end of the second curved rail 14B adjacent to the outside of the second rail 12B of the main track 12. The second set 23 is configured for positioning along the turnout track 14 and spaced a distance S longitudinally relative to the first set 21 for mounting over the turnout track 14. Specifically, rail transition device 300 is configured for mounting over the second end 17 of the first transition rail 14T1, and rail transition device 400 is configured for mounting over at least a portion of the second curved rail 14B.

The distance S between the sets 21 and 23 can be measured between ends of the rail transition devices, for example. In an embodiment, the distance S between first set 21 and second set 23 is approximately 50 feet. In another embodiment, the distance S is approximately 30 feet. In yet another embodiment, the distance S between first set 21 and second set 23 can be within a range of approximately 20 feet (inclusive) to approximately 60 feet (inclusive).

Each rail transition device 100, 200, 300, and 400 of the first and second sets 21 and 23 is configured for attachment to predetermined ties of the plurality of turnout ties when positioned under the main and turnout tracks 12 and 14. That is, as noted above and shown in FIGS. 24-35, the turnout ties 18A-18L can be formed with turnout plates 22 and attachment plates 20 for their attachment to rails of the tracks 12 and/or 14, as well as for attachment to one or more of the rail transition device(s) 100, 200, 300, and/or 400. In accordance with one embodiment, as explained in detail later, the rail transition devices 100, 200, and 300 are configured for vertical adjustment relative to the rails 14A and 14B of the turnout track 14 (e.g., when being assembled and installed).

Each rail transition device 100, 200, 300, and 400 comprises a body portion 60 and leg portions 30. Such features can be generally seen in FIGS. 2 and 3, for example. The body portion 60 of each rail transition device 100, 200, 300, and 400 has a longitudinal surface and arm portions 61 extending downwardly therefrom. The longitudinal surface and arm portions can be formed integrally together or assembled to form an integral part (e.g., welded together). Arm portions 61 are attached to an underside of its ends and positioned perpendicularly to the longitudinal surface. Arm portions 61 are configured for alignment with and attachment to leg portions 30 positioned on either side of the body portion 60. Generally, the body portion 60 comprises an upside-down "U"-shape.

Figure 23:
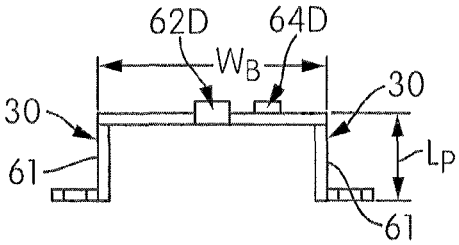
Figure 24:
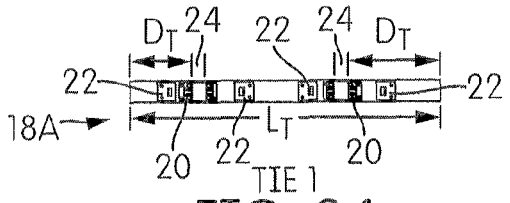
FIGS. 24-35 illustrate ties used with the system of FIG. 1B, in accordance with an embodiment.
Figure 25:
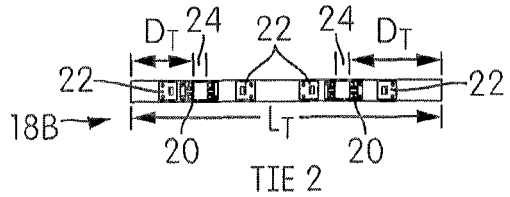
Figure 26:
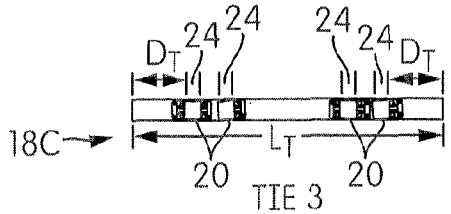
Figure 27:
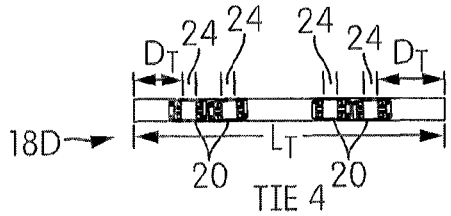
Figure 28:
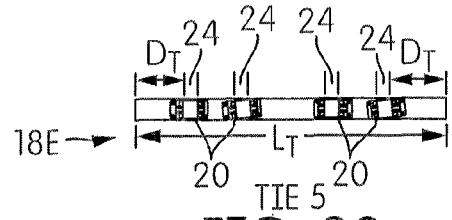
Figure 29:
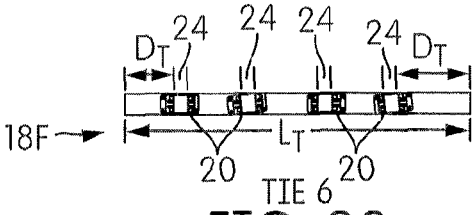
Figure 30:
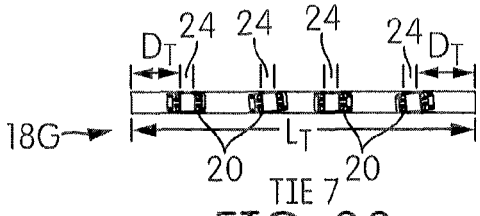
Figure 31:
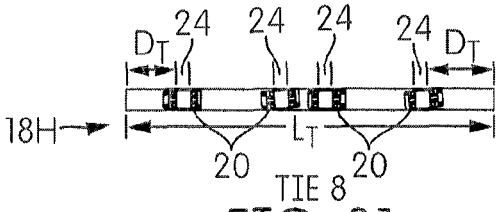
Figure 32:
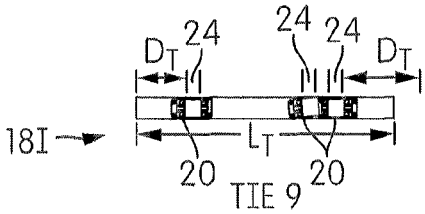
Figure 33:
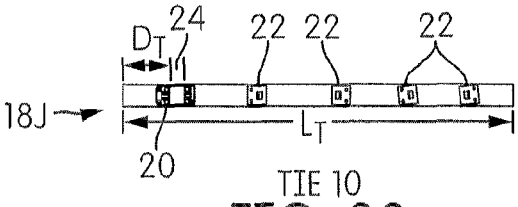
Figure 34:
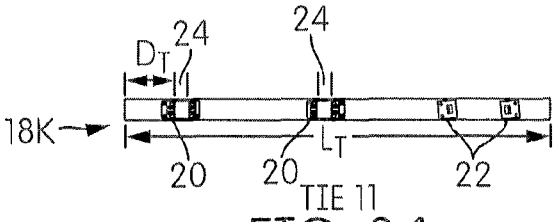
Figure 35:
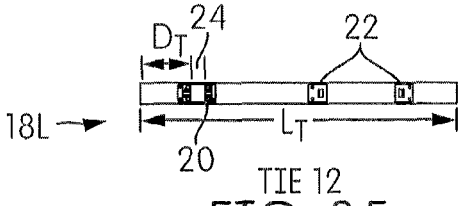

In accordance with another embodiment, body portion 60 includes integrally formed arm portions 61 that are used as leg portions 30 on either of its sides (e.g., see FIG. 23).

Figure 8:
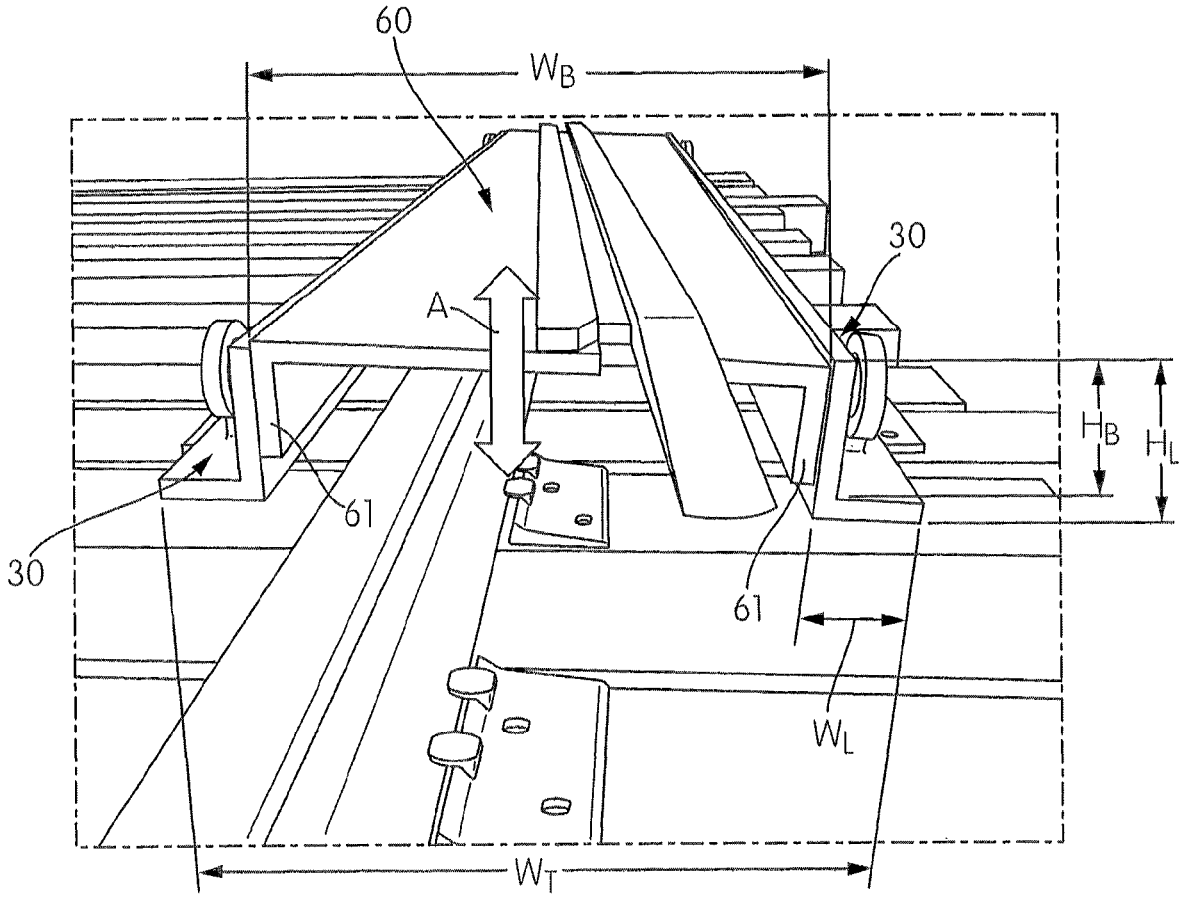
FIG. 8 is an end perspective view of a rail transition device.

As shown in FIG. 8, the body portion 60 has an overall height HB (measured from a top of longitudinal surface to a bottom of arm portion 61) and an overall width WB (measured in a lateral direction across the longitudinal surface, from arm portion 61 to arm portion 61). In one embodiment, the height HB is approximately 5½ inches. In an embodiment, the width WB is between approximately 18 inches (inclusive) and approximately 30 inches (inclusive). In one embodiment, the width WB is approximately 20 inches. In another embodiment, the width WB is approximately 25 inches. In yet another embodiment, the width WB is approximately 28 inches.

The longitudinal surface of each body portion 60 has a ramped guide portion 62 provided thereon, with ramps 66 at either end. Each body portion 60 is configured for mounting over at least a portion of the turnout track 14 such that at least one of its ramps 66 of its guide portion 62 are aligned with at least one rail 14A or 14B of the turnout track 14 (e.g., see FIG. 1A). Guide portions 62 may be provided at an angle relative to the longitudinal surface, for example, based on the angle of the rail it is aligned with. Ramps 66 extend from each of the ends of the guide portion 62 and are angled (vertically) relative to the rail. Each guide portion 62A has a first (e.g., front or entrance) and a second (e.g., back or exit) ramp 66 extending a length LR from the ends of the body 60, each of which are configured for alignment with and placement on rails. Ramps 66 provide smooth entry and exit as a vehicle or rail equipment moves along the longitudinal surface of the associated rail transition device. The ramp 66 acts as the surface upon which the treat portion of a wheel is able to travel over the existing track structure. At least one of the ramps 66 (e.g., a second or exit ramp) is configured for alignment with a rail of the turnout track 14 (e.g., see FIG. 2) and, when the devices are installed, configured to guide wheels of rail equipment from rails 12A and 12B of the main track 12 at an angle and onto the guide portions 62 of each of its relative rail transition device, so that the wheels are guided towards and along the parallel rails 14A and 14B of the turnout track 14. In an embodiment, the angles of the ramps 66 for each rail transition device are similar. In another embodiment, the angles of the first (e.g., front or entrance) ramps for each rail transition device are similar. In another embodiment, the angles of the second (e.g., back or exit) ramps for each rail transition device are similar. The angles of the first ramps 66 can be different from the second ramps 66. As an example, the angle of entry and/or exit using ramps 66 may be between approximately 15 degrees (inclusive) and approximately 35 degrees (inclusive).

A length LF of the longitudinal surface of each of the body portions (see LF1 in FIG. 10, LF2 in FIG. 14, etc.) of each rail transition device (not including a length of each of the ramps 66) can vary depending on the placement of the respective device along on the turnout track. In accordance with an embodiment, the overall length LF of the body portion is within a range of approximately 100 inches (inclusive) to approximately 130 inches (inclusive). Each of the ramps 66 extends a length LR from the ends of the body portion 60. In accordance with one embodiment, the length LR of a ramp 66 is within a range of approximately 10 inches (inclusive) to approximately 12 inches (inclusive). An overall length LT (not shown) of each body portion may include the length LF of the body portion as well as the length of ramp 66 extending therefrom. A width WT of the body portions can also vary depending on the placement of the respective device along on the turnout track.

Overall length LT and overall width WT of each the rail transition devices 100, 200, 300, and 400, alternatively including the lengths/widths of their respective ramps, can vary depending on the placement of the device on the turnout track. In accordance with an embodiment, the overall length LF of a rail transition device is within a range of approximately 145 inches (inclusive) to approximately 150 inches (inclusive). In accordance with an embodiment, the overall width WT of a rail transition device is within a range of approximately 28 inches (inclusive) to approximately 40 inches (inclusive).

Figure 2:
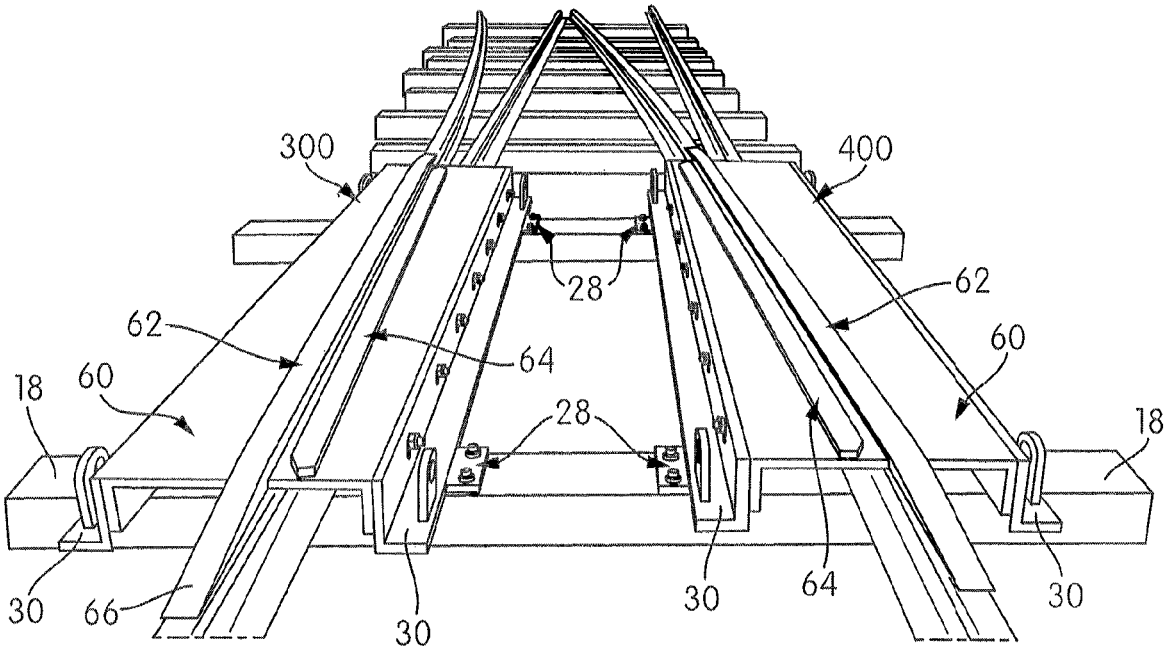
FIG. 2 is an end perspective view of two of the rail transition devices of the system of FIG. 1B.
Figure 3:
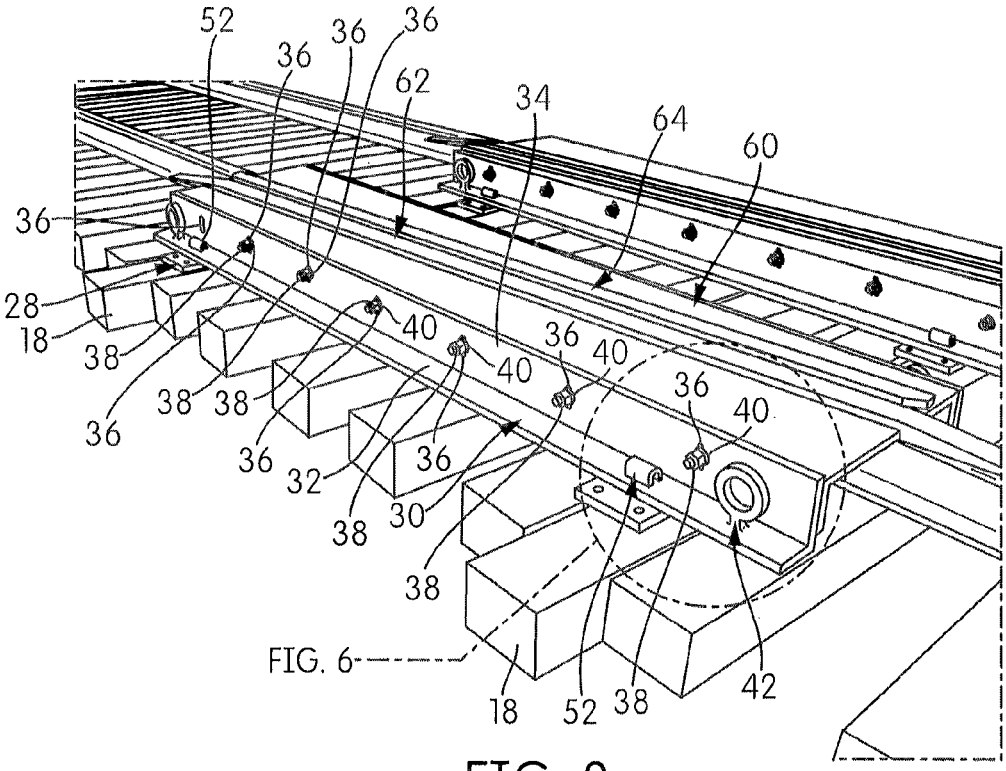
FIG. 3 is a side perspective view of the two rail transition devices of FIG. 2.

To assist in guiding wheels of rail equipment towards the rails 14A and 14B of the turnout track 14 and to guard from displacement of the wheels from the guide portion 62 by balancing rail equipment, each transition device 100, 200, 300, and 400 further includes a guard rail 64 thereon, as shown in FIGS. 2 and 3. Each guard rail 64 runs parallel to each guide portion 62 on the top of the longitudinal surface of the body portion 60. The guard rail 64 is provided on an internal side of the longitudinal surface relative to the rail(s) that the ramps 66 are aligned with. A space or flangeway 70 is provided between the guide portion 62 and the guard rail 64 is configured to at least partially receive wheels of the rail equipment for their travel along the respective device and to reduce and/or eliminate displacement and/or imbalance, and to guide the wheels along the guide portion 62 (e.g., see FIGS. 10, 14, 18, and 21). That is, the guard rail 64 acts as a safety device to ensure that if the wheels do not enter the ramp 66 in a correctly oriented fashion, the guard rail 64 forces the flange of the wheel into the space or flangeway 70 between the ramp 66 and the guard rail 64. For example, a first axle of a piece of equipment may align and have its wheels be guided along guide portion 62 in an acceptable manner, while a second axle of the equipment can have a tendency to turn or twist relative to the rail transition device. As the wheels on each axle go into the flangeway 70, the wheels are aligned between the guide portion 62 and the guard rail 64, ensuring alignment of the wheels on each of the axles for guidance by the rail transition device.

Leg portions 30 of each rail transition device 100, 200 and 300 are configured to be removably connected to the body portion 60 and to the selected predetermined ties of the plurality of turnout ties 18A-18L, in accordance with an embodiment. Once installed to its designated turnout tie(s), each leg portion 30 is static. As shown in FIGS. 2, 3, and 8, for example, in one embodiment, each of the leg portions 30 is an "L"-shaped bracket comprising a horizontal portion 32 and a vertical portion 34. The vertical portion 34 is substantially perpendicular to the horizontal portion 32. The horizontal portion 32 is configured for connection to one of the predetermined ties of the plurality of turnout ties 18A-18L, and the vertical portion 34 is configured for connection to the body portion 60. More specifically, the vertical portion 34 is configured for connection with an arm portion 61 of the body portion 60. To attach each arm portion 61 with vertical portion 34 of each leg portion 30, a plurality of holes (not shown) can be spaced longitudinally along a length of the arm portion 61. A plurality of attachment bolts 38 (or other fasteners) are provided through each of the holes of the arm portions 61, and thus are provided in a spaced configuration along a length of the arm portion 61. The attachment bolts 38 extend laterally from each arm portion 61 (e.g., see FIG. 3). The attachment bolts 38 are configured for receipt through a corresponding slot, for example, in the aligned leg portions 30. In accordance with an embodiment, the leg portions of at least one the rail transition devices 100, 200, and/or 300 include adjustment slots 36 configured to enable vertical adjustment of the body portion 60 relative to the leg portions 30 and the rails of the turnout track. Collectively, the leg portions 30 and arm portions 61 permit each rail transition device to be adjusted vertically. Vertical adjustment of the leap frog ensures that various rail sizes can be accommodated. In the Figures, each of rail transition devices 100, 200, and 300 have adjustment slots 36 in their leg portions 30. The plurality of adjustment slots 36 are vertically elongated and provided in a spaced configuration along a length of the vertical portion 34 of each leg portion 30. Each attachment bolt 38 of arm portion 61 can be aligned with and inserted through each adjustment slot 36 of the vertical portion 34 and secured with a nut 40 (see FIG. 6) in a selected position along the length of the slot.

In accordance with an embodiment, a rail transition device need not include adjustment slots 36 and/or attachment bolts 28 for vertical adjustment. Vertical adjustment relative to a rail may not be required. For example, as explained in greater detail below with respect to FIG. 23, rail transition device 400 may be manufactured with attached leg portions 30 (or arm portions 61) to form a single piece body portion 60D designed for placement over and alignment with a rail (e.g., rail 14B).

As shown in FIG. 8, each leg portion 30 has an overall height HL (measured from a top of vertical portion 34 to a bottom of horizontal portion 32) and an overall width WL (measured in a lateral direction along a bottom of horizontal portion 32). In an embodiment, the height HL is between approximately 5 inches (inclusive) and approximately 8 inches (inclusive). In one embodiment, the height HL is approximately 7⁄16 inches. In another embodiment, the height HL is approximately 5½ inches. In yet another embodiment, the height HL is approximately 7¾ inches. In an embodiment, the overall width WL is approximately 5 inches. In one embodiment each of the horizontal portion 32 and vertical portion 34 has a thickness of approximately 1 inch.

In another embodiment, angled end portions 58 are further associated with leg portions 30. For example, as further described below and shown in FIG. 18, a body portion 60 and/or leg portions 30 may include angled areas at ends thereof to accommodate, for example, a curvature of rails and positioning of a rail transition device for proper alignment with an attachment to a turnout tie.

Figure 4:
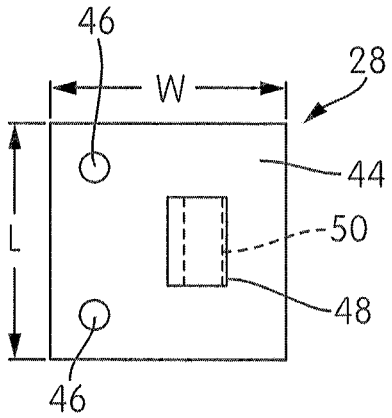
FIGS. 4 and 5 are top and side views, respectively, of a plate used with the devices of the rail transition system of FIG. 1B.
Figure 7:
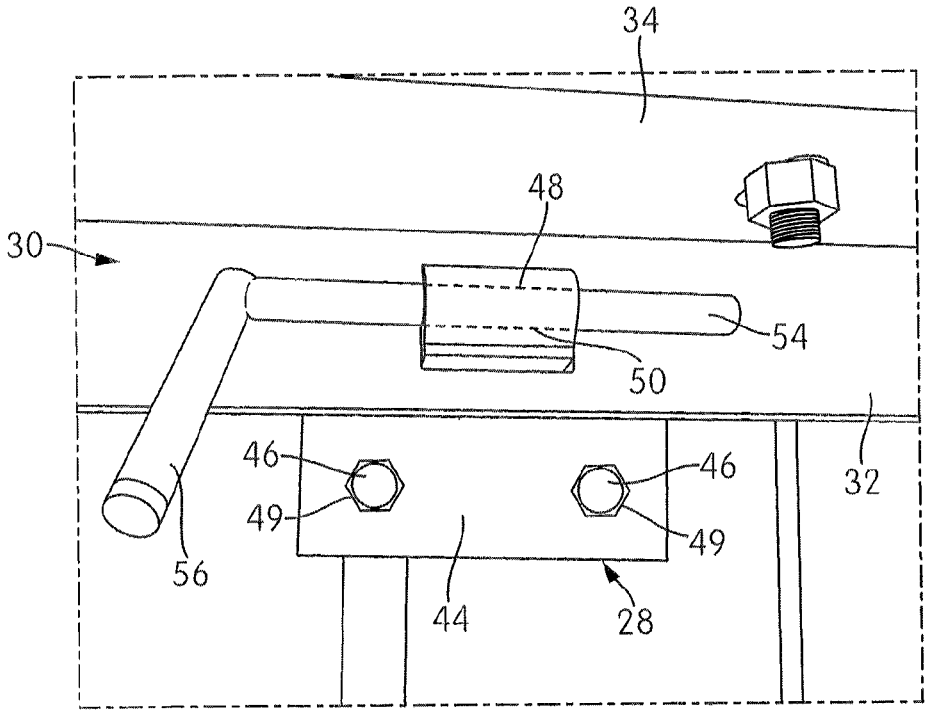
FIG. 7 shows a detailed, overhead view of the plate of FIGS. 4 and 5 installed for use with the system shown in FIG. 1B.

Attachment brackets 28 can be used with system 100 to connect the horizontal portion 32 of each of the leg portions 30 to the predetermined turnout ties. As shown in greater detail in FIGS. 4 and 5, each attachment bracket 28 includes a securement plate 44 with a male extension portion 48 extending upwardly therefrom. The securement plate 44 comprises a length L and a width W (see FIG. 4) and a height (see FIG. 5). In accordance with one embodiment, the securement plate 44 is substantially square in shape. That is, length L and width W are substantially equal in dimension. In one embodiment, length L and width W of the securement plate 44 are approximately 8 inches. In an embodiment, the height H of the securement plate 44 is approximately 1 inch. One or more bolt receiving slots 46 extend through the securement plate 44. Slots 46 are configured to receive a bolt 49 (or other similar fastener device) therethrough in order to secure the securement plate 44 of the attachment bracket 28 to a predetermined turnout tie, as shown in FIG. 7.

Figure 5:
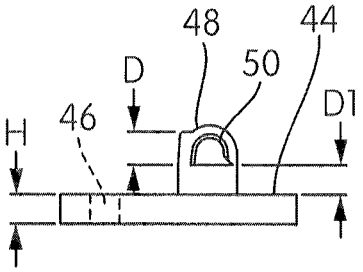

The extension portion 48 has a slot 50 extending therethrough. As shown in FIG. 5, the slot may be positioned at a distance D1 from a top of the securement plate 44. The width D or diameter of the slot 50 is not limiting. In one embodiment, the width D is approximately 1⅛ inches. In another embodiment, the width D of the slot 50 is based on the width or diameter of the locking device (e.g., pin 54, noted below) inserted therethrough.

Figure 6:
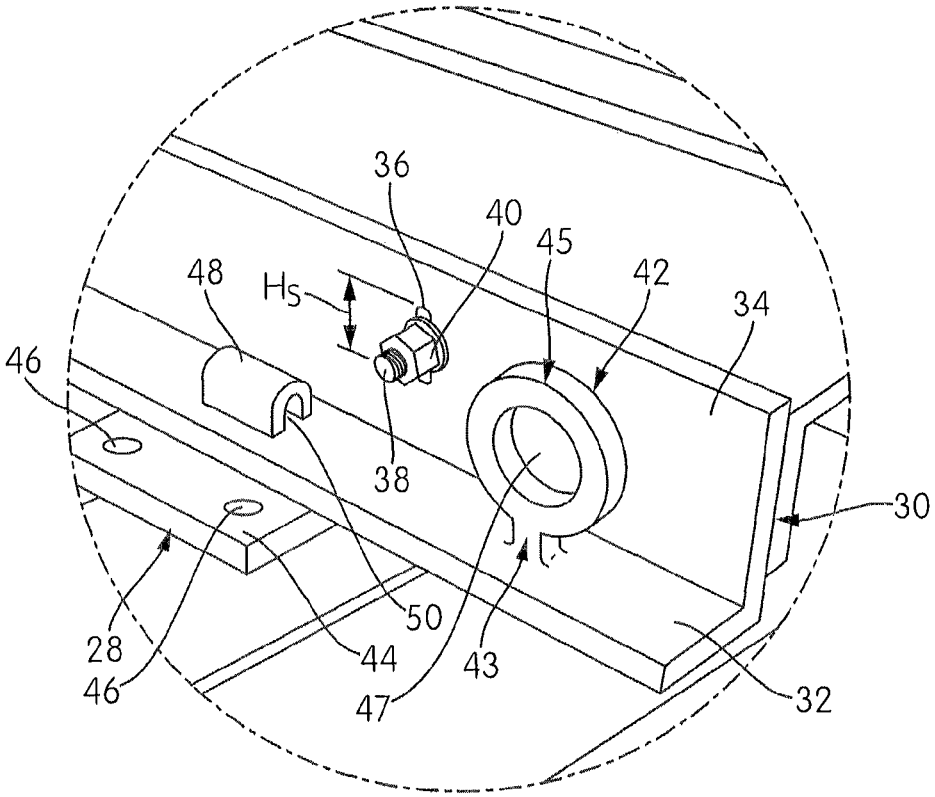
FIG. 6 shows a detailed view of parts of FIG. 3.

The horizontal portion 32 of each leg portion 30 has at least one receiving (female) opening 52 configured for alignment with and to receive the (male) extension portion 48 of the attachment bracket 28 therethrough. As shown in FIGS. 3 and 6, for example, the extension portion 48 is aligned with and inserted upwardly through receiving opening 52 such that the slot 50 can be used to secure the leg portion 30 and the attachment bracket 28 together. In accordance with an embodiment, shown in FIG. 7, a pin 54 is configured for insertion through the slot 50 of the extension portion 48 of the attachment portion 28 to act as a locking device. A pin 54 can be provided for each attachment bracket 28 used to attach the associated rail transition device. The pin 54 is a mechanical fastening device used to ensure that its rail transition device, once installed, do not move vertically, longitudinally or laterally relative to the top surface of the tie it is attached to. The design of the pin 54 is not meant to be limiting and is an example device that can be used for securing the parts. Other devices, such as clips or fasteners, may alternatively be used. Referring back to FIG. 7, after the extension portion 48 is received by the horizontal portion 32, as shown, the pin 54 can be aligned with and slid (e.g., in a horizontal direction) through slot 50. Optionally, pin 54 has a handle 56 attached thereto for easier insertion and removal of the pin 54 relative to the extension portion 48 (see FIG. 7).

In accordance with an embodiment, at least two receiving openings 52 are provided along a length of each horizontal portion 32. Accordingly, at least two attachment brackets 28 are used to connect each leg portion 30, i.e., a total of four attachment brackets 28 are used to connect a rail transition device to predetermined turnout ties. However, the number of attachment brackets 28 and openings 52 in leg portions 30 is not meant to be limiting. Further, although not shown, it is within the scope of this disclosure that the leg portions 30 may optionally be attached to existing ties 16 under the main track 12.

The positioning of the receiving openings 52 along the leg portions 30 is not limiting. In accordance with an embodiment, the receiving openings 52 are positioned approximately 12 inches to approximately 18 inches from an adjacent end of the leg portion.

In addition, in an embodiment, the body portion 60 is vertically adjustable relative to the leg portions 30 and the rails 14A and 14B of the turnout track 14. For example, in some cases, the height of the rails upon which each rail transition device is installed can vary, e.g., based upon the sizes of the rails (e.g., 110#, 141#) vary the height of the top of the rail. Thus, the height or elevation of the body portion 60 may need to be adjusted (in the vertical direction, upwardly or downwardly) in order to properly align the ramps 66 on either side with their respective rail to achieve the required elevation. An elevation of at least the body portion 60 of some or each of the rail transition devices can be adjusted to accommodate rail sizes. To enable vertical adjustment of the body portion 60, the vertically elongated adjustment slots 36 along each leg portion 30 comprises a height HS, as shown in FIG. 6. The height HS of each adjustment slot 36 can therefore substantially correspond to an amount of vertical adjustment of the relative body portion 60. In one embodiment, the height HS is approximately 1½ inches (inclusive) to approximately 4 inches (inclusive). In an embodiment, the height HS of each adjustment slot 36 is approximately 2½ inches. In an embodiment, each adjustment slot 36 is sized with dimensions (e.g., height HS) to accommodate a height adjustment between rail heights of approximately 5 41/64 inches and approximately 7 7/16 inches. FIG. 8 shows an end perspective view of a rail transition device with arrow A indicating relative vertical movement or adjustment of the body portion 60 to the L-shaped leg portions 30. Nuts 40 are loosened to adjust elevation of body portion 60. Once moved to a desired position, each nut 40 for each attachment bolt 38 extending through the arm portions 61 is tightened to secure body portion 60 to leg portion 30.

In an embodiment, each adjustment slot 36 is sized with width dimensions based on the type of attachment bolt to be used. In one embodiment, each of the attachment bolts 38 is a 1" A325 Type 3 bolt. In accordance with one embodiment, the adjustment slots 36 have a width of approximately 1⅛ inches.

Figure 9:
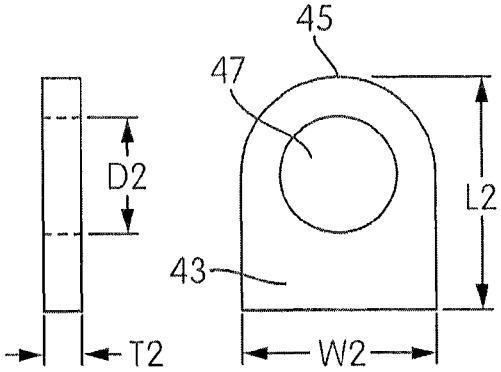
FIG. 9 shows an alternate embodiment of an optional eye bolt for use with rail transition devices.

Optionally, one or more of the rail transition devices further comprises a structure thereon configured for receipt of a device for lifting and moving the rail transition device relative to the track to install or remove the rail transition device from the track structure. As shown in FIGS. 3 and 6, for example, a structure in the form of an eye bolt 42 may be provided on or more of the leg portions 30. For example, an eye bolt may be provided at each end of each leg portions, i.e., two eye bolts per leg portion, four eye bolts per rail transition device (e.g., one in each corner). FIG. 9 shows an alternate embodiment of an optional eye bolt 42 that can be used. The eye bolt(s) 42 can be used as pick points to enable safe lifting and transportation of a rail transition device within a yard and along a track. Despite its design, each eye bolt 42 can have a base 43 with a rounded portion 45 attached thereto and generally extending vertically therefrom. An opening 47 is provided through rounded portion 45. The opening 47 is configured to receive chains or other devices, for example, when lifting and moving rail transition devices to a designated area along a track for installation.

The optional eye bolt 42 can have an overall length L2, width W2, thickness, T2, and its opening 47 can have a width D2 or diameter. In an embodiment, the length L2 is not greater than a height of the vertical portion 34 of leg portion 30 (e.g., so as not to extend above the longitudinal surface of body portion 60). In one embodiment, the length L2 is approximately 6 inches. In one embodiment, the width W2 is approximately 5 inches. In one embodiment, the thickness T2 is approximately 1 inch. In one embodiment, the width D2 of the opening 47 is approximately 3 inches.

Figure 12:
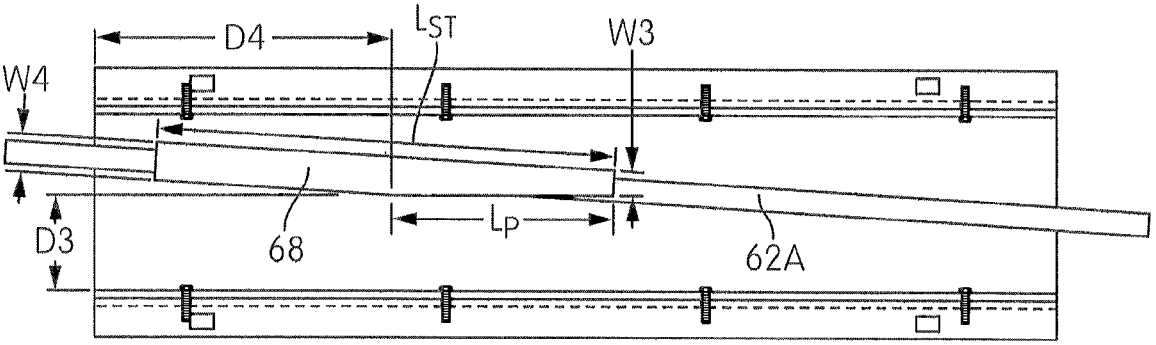
Figure 16:
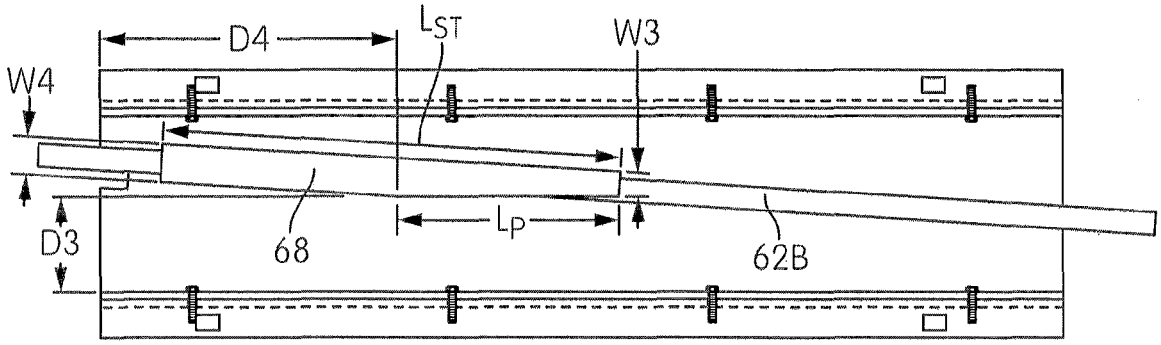

Also optionally associated with a body portion 60 of a rail transition device is a stiffener 68, as shown in FIGS. 12 and 16, for example. Stiffener 68 aids in substantially reducing and/or substantially eliminating warping and deformation along at least the length of the body portion 60 when a rail transition device is installed on top of a rail. Stiffener 68 is provided on an underside of the longitudinal surface of a body portion 60. More specifically, stiffener 68 can be angularly aligned (on the underside of the longitudinal surface) for placement substantially on top of the rail. Stiffener 68 can also be angularly aligned (on the underside of the longitudinal surface) with the ramped guide portion 62 (on the upper or top side of the longitudinal surface). In one embodiment, stiffeners 68 are associated with at least the first set 21 of rail transition devices 100 and 200. A stiffener 68 may also be provided with rail transition device 300. In an embodiment, the stiffener is formed from a steel beam.

The stiffener 68 may be attached to an underside of the body portion 60 using welding or other methods, for example. In one embodiment, the stiffener 68 is welded to the underside of the longitudinal surface of body portion 60 with a continuous weld (e.g., 5/16" fillet weld).

Stiffener 68 has an overall length LST and a width W4. Also, the stiffener may include a reduced or angled portion along its length that has a length LP and a width W3. The reduced portion of the stiffener is positioned relative to the width of the body portion 60 a distance D3 from one of the leg portion 30 (e.g., see FIG. 12) when aligned at an angle with the guide portion 62 of the body portion 60. The reduced portion of the stiffener is positioned relative to the length of the body portion 60 a distance D4 from an end of the body portion 60, as also shown in FIG. 12. The stiffener can be formed from a stock piece of steel that is approximately 3 inches×3 inches×approximately 12 inches (inclusive) to approximately 22 inches (inclusive). In one embodiment, the overall length LST of the stiffener is approximately 60 inches. In one embodiment, the width W4 is approximately 5 inches. The length LP of the reduced portion is between approximately 28½ inches (inclusive) and approximately 29½ inches (inclusive). In one embodiment, the width W3 of the reduced portion is approximately 3¼ inches. In an embodiment, the distance D3 between a leg portion and an end of the stiffener (along a width of the body portion 60) is between approximately 12 inches (inclusive) and approximately 14 inches (inclusive). In an embodiment, the distance D4 between an end of the body portion and the reduced portion (along a length of the body portion 60) is between approximately 38 inches (inclusive) and approximately 42 inches (inclusive).

In accordance with an embodiment, the features associated with each of the four transition devices 100, 200, 300, and 400 can be designed based on the curve radius of the turnout track 14 being used as well as their configured location for placement relative to the turnout track 14. For example, details regarding each of the rail transition devices associated with a turnout track having a curve radius of nine degrees can be seen in FIGS. 10-23.

Figure 10:
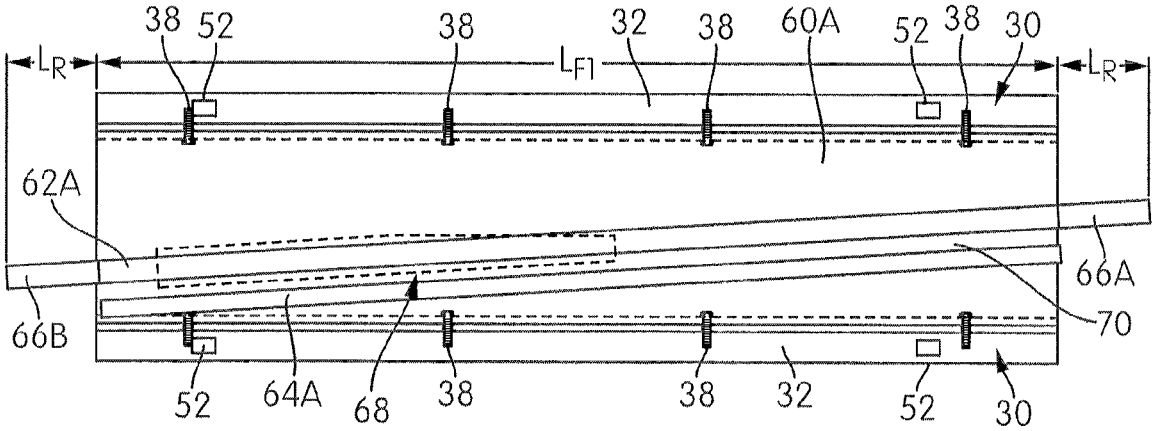
FIGS. 10-13 illustrate top, side, bottom, and end views of a first rail transition device of the system of FIG. 1B in accordance with one embodiment.

FIGS. 10-13 illustrate top, side, bottom, and end views of first rail transition device 100 of the system 100, in accordance with one embodiment. First rail transition device 100 comprises a body 60A with guide portion 62A and guard rail 64A positioned on a top of its longitudinal surface, as shown in FIG. 10, with connected leg portions 30 on either of its sides. Body 60A has a longitudinal length LF1 of approximately 126 inches. Guide portion 62A is positioned at an angle relative to the elongated body portion 60A. Guide portion 62A has a first (e.g., front or entrance) and second (e.g., back or exit) ramps 66A and 66B each extending a length LR from the ends of the body 60A, each of which are configured for alignment with and placement on rails (e.g., first rail 12A of main track 12 and first transition rail 14T1 of first curved rail 14A of turnout track 14, as shown in FIG. 1B). The length LR of the ramps 66A and 66B is between approximately 11½, inches (inclusive) and approximately 12 inches (inclusive). Each of the ramps 66A and 66B of the guide portion 62A is positioned at an angle relative to the elongated body portion 60A, and can vary as previously noted, in order guide wheels upon entry onto the elongated body portion 60A and exit therefrom. The space or flangeway 70 between the guide portion 62A and guard rail 64A is approximately 2¼ inches.

Figure 11:
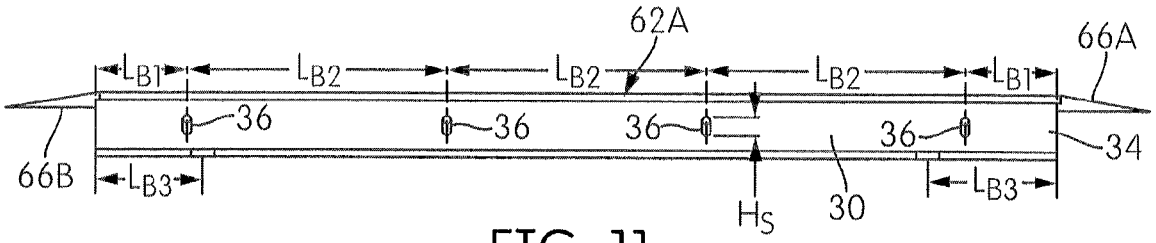

Four adjustment slots 36 are provided in the leg portions 30 of first rail transition device 100 (e.g., see FIG. 11). Accordingly, four attachment bolts 38 are inserted through the corresponding holes in the arm portions 61 (not shown) and are provided and inserted through the slots 36. The slots 36 are provided a distance or length LB1 from each end of the leg portion 30, and a distance or length LB2 relative to each other, as shown in FIG. 11. In an embodiment, the distance LB2 is approximately 12 inches, and the distance LB2 between each slot 36 is approximately 34 inches. Receiving openings 52 are also provided in leg portions 30 (e.g., see FIG. 10) to align with attachment brackets 28 and to connect the device to predetermined turnout ties. Additionally, the location of receiving openings 52 on leg portions 30 can vary. In an embodiment, the receiving openings 52 are provided a distance or length LB3 from each end of the leg portion 30 to a center of the opening 52, as shown in FIG. 11. In an embodiment, the distance LB3 is within a range between approximately 12 inches (inclusive) and approximately 24 inches (inclusive). In another embodiment, the distance LB3 is approximately 17 inches. In yet another embodiment, the distance LB3 is approximately 14 inches. In still yet another embodiment, each receiving opening 52 may be provided at difference distances LB3 from the end of the leg portion 30. For example, one receiving opening 52 can be approximately 14 inches from a first end of a leg portion 30, while another receiving opening 52 can be approximately 17 inches from a second end of the leg portion 30. Accordingly, the spacing or distances of the slots 36 and receiving openings 52 may vary.

Figure 13:
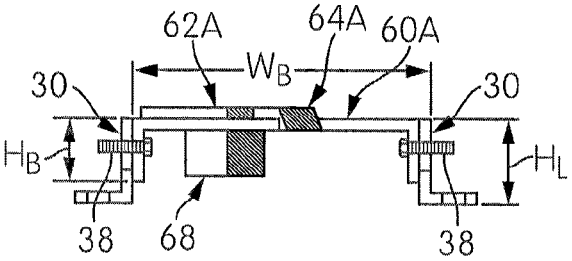

Stiffener 68A is provided on an underside of the longitudinal surface of the body 60A, as shown in FIG. 12, angularly in line with the guide portion 62A (guide portion 62A being on a top surface thereof, and stiffener 68A underneath or on an underside of the body 60A). The reduced portion of the stiffener is positioned a distance D3 of approximately 12½ inches from leg portion 30 along the width of the body portion 60A, and is positioned a distance D4 of approximately 39 inches from an end of the body portion 60A. Stiffener 68A has an overall length LST of approximately 60 inches, width W4 of approximately 5 inches, length LP of reduced portion of approximately 29$^{1}/_{16}$ inches, and width W3 of reduced portion of approximately 3¼ inches. FIG. 13 illustrates an end view of the first rail transition device 100.

Figure 14:
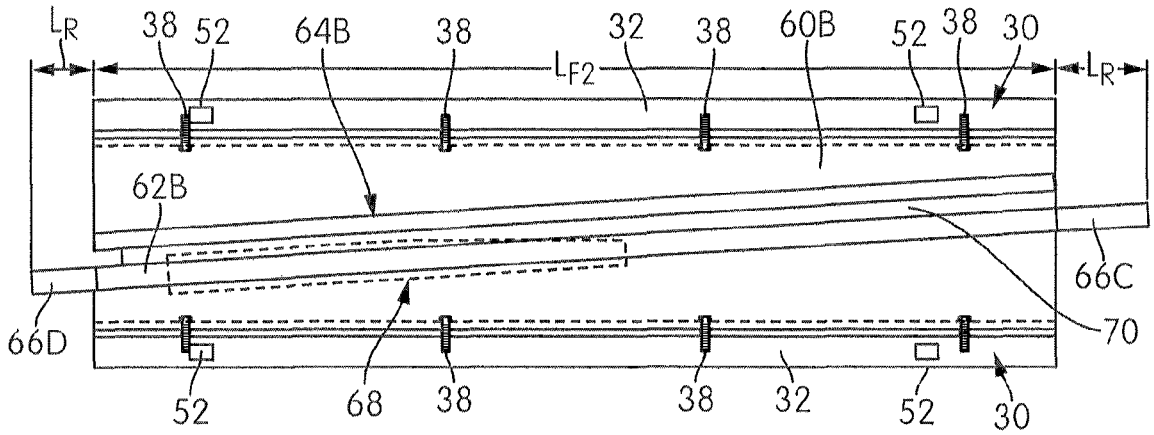
FIGS. 14-17 illustrate top, side, bottom, and end views of a second rail transition device of the system of FIG. 1B in accordance with one embodiment.

FIGS. 14-17 illustrate top, side, bottom, and end views of second rail transition device 200 of the system 100, in accordance with one embodiment. Second rail transition device 200 comprises a body 60B with guide portion 62B and guard rail 64B positioned on a top of its longitudinal surface, as shown in FIG. 14, with connected leg portions 30 on either of its sides. Body 60B has a longitudinal length LF2 of approximately 126 inches. Guide portion 62B is positioned at an angle relative to the elongated body portion 60B. Guide portion 62B has a first (e.g., front or entrance) and second (e.g., back or exit) ramps 66C and 66D each extending a length LR from the ends of the body 60B, each of which are configured for alignment with and placement on rails (e.g., second rail 12B of main track 12 and second curved rail 14B of turnout track 14, as shown in FIG. 1B). The length LR of the ramps 66C and 66D is between approximately 8$^{7}/_{32}$ inches (inclusive) and approximately 12 inches (inclusive). Each of the ramps 66C and 66D of the guide portion 62B is positioned at an angle relative to the elongated body portion 60B, and can vary as previously noted, in order guide wheels upon entry onto the elongated body portion 60B and exit therefrom. The space or flangeway 70 between the guide portion 62B and guard rail 64B is approximately 2¼ inches.

Figure 15:
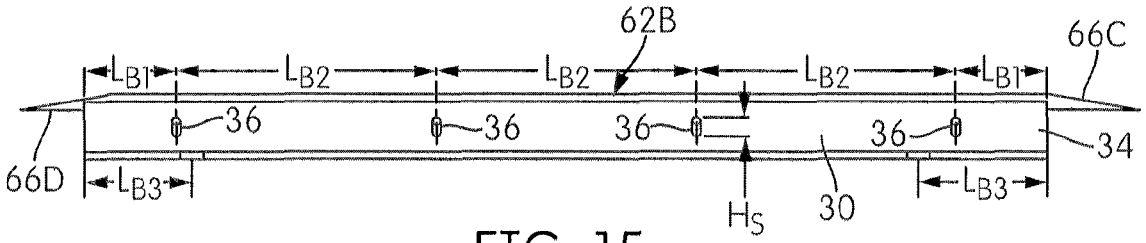

Like first rail transition device 100, four adjustment slots 36 and four attachment bolts 38 can be provided in second rail transition device 200 (e.g., see FIG. 15). Receiving openings 52 are also provided in leg portions 30 (e.g., see FIG. 14) to align with attachment brackets 28 and to connect the device to predetermined turnout ties. Since the dimensions LB1, LB2, LB3, etc. associated with the slots 36 and bolts 38 and openings 52 for second rail transition device 200 are substantially similar to first rail transition device 100, as shown, their description and alternatives are therefore are not repeated.

Figure 17:
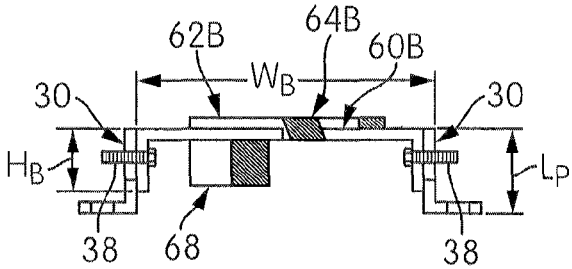

Stiffener 68B is provided on an underside of the longitudinal surface of the body 60B, as shown in FIG. 16, angularly in line with the guide portion 62B (guide portion 62B being on a top surface thereof, and stiffener 68B underneath or on an underside of the body 60B). The reduced portion of the stiffener is positioned a distance D3 of approximately 12$^{7}/_{16}$ inches from leg portion 30, and is positioned a distance D4 of approximately 41 inches from an end of the body portion 60B. Stiffener 68B has an overall length LST of approximately 60 inches, width W4 of approximately 5 inches, length LP of reduced portion of approximately 28$^{13}/_{32}$ inches, and width W3 of reduced portion of approximately 3¼ inches. FIG. 17 illustrates an end view of the second rail transition device 200.

Figure 18:
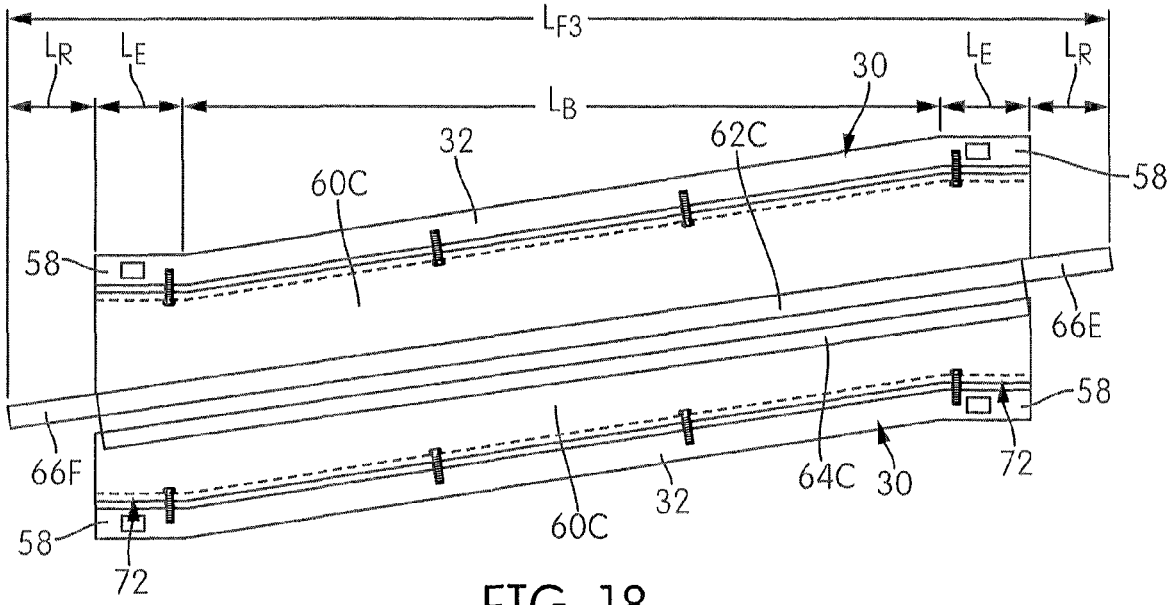
FIGS. 18-20 illustrate top, side, and end views of a third rail transition device of the system of FIG. 1B in accordance with one embodiment.
Figure 19:
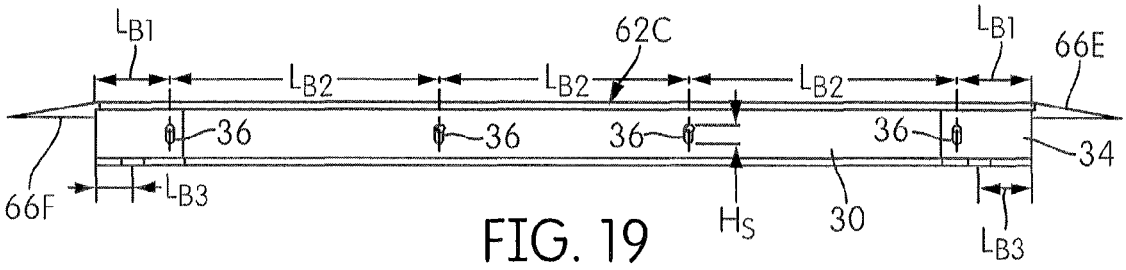
Figure 20:
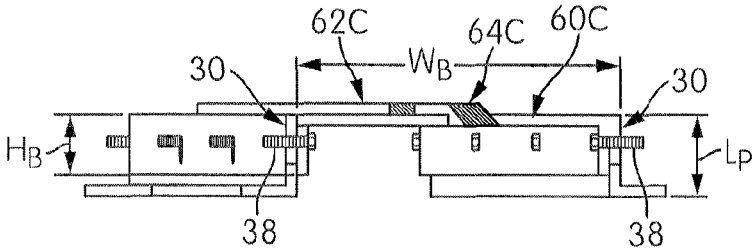

FIGS. 18-20 illustrate top, side, and end views of a third rail transition device 300 of the system 100, in accordance with one embodiment. Third rail transition device 300 comprises a body 60C with guide portion 62C and guard rail 64C positioned on a top of its longitudinal surface, as shown in FIG. 18, with connected leg portions 30 on either of its sides. Body 60C has a longitudinal length LF3 of approximately 102 inches. Guide portion 62C can be positioned at an angle relative to the elongated body portion 60C. In accordance with another embodiment, guide portion 62C runs substantially parallel to arm portions 61 of body portion 60C. Guide portion 62C has a first (e.g., front or entrance) and second (e.g., back or exit) ramps 66E and 66F each extending a length LR from the ends of the body 60C, each of which are configured for alignment with and placement on rails (e.g., first transition rail 14T1 of first curved rail 14A of turnout track 14 and second transition rail 14T2 of second curved rail 14B of turnout track 14, as shown in FIG. 1B). The length LR of the ramps 66E and 66F is between approximately 10¾ inches (inclusive) and approximately 11$^{23}/_{32}$ inches (inclusive). Each of the ramps 66E and 66F of the guide portion 62C is positioned at an angle relative to the elongated body portion 60C, and can vary as previously noted, in order guide wheels upon entry onto the elongated body portion 60C and exit therefrom. The space or flangeway 70 between the guide portion 62C and guard rail 64C is approximately 2¼ inches.

Like first and second rail transition devices 100 and 200, four adjustment slots 36 and four attachment bolts 38 can be provided in third rail transition device 300 (e.g., see FIG. 19). Receiving openings 52 are also provided in leg portions 30 (e.g., see FIG. 18) to align with attachment brackets 28 and to connect the device to predetermined turnout ties. Since the dimensions LB1, LB2, LB3, etc. associated with the slots 36 and bolts 38 and openings 52 for third rail transition device 300 are substantially similar to first rail transition device 100 and second rail transition device 200, as shown, their description and alternatives are therefore are not repeated.

However, it is noted that leg portions 30 of third rail transition device 300 as shown in FIGS. 18-20 include angled end portions 58 on at least its leg portions 30. In accordance with an embodiment, body portion 60C may also include end portions 58 that are angled relative to its elongated body. Each angled end portion 58 is angled relative to the elongated structure of the horizontal leg extensions 32 of each leg portion 30. As previously noted, these end portions 58 can be provided at an angle in order to accommodate, for example, a curvature of rails and/or a positioning of a rail transition device on top of a turnout tie, so that it can be properly aligned with one or more turnout ties for attachment thereto. Moreover, as shown in FIG. 20, the elongated structures of the leg portions 30 and body portion 60 can be positioned at an angle.

Also, in an embodiment, a stiffener (not shown) can provided on an underside of the longitudinal surface of the body 60C, and may be angularly in line with the guide portion 62C (guide portion 62C being on a top surface thereof, and stiffener underneath or on an underside of the body 60C).

Figure 21:
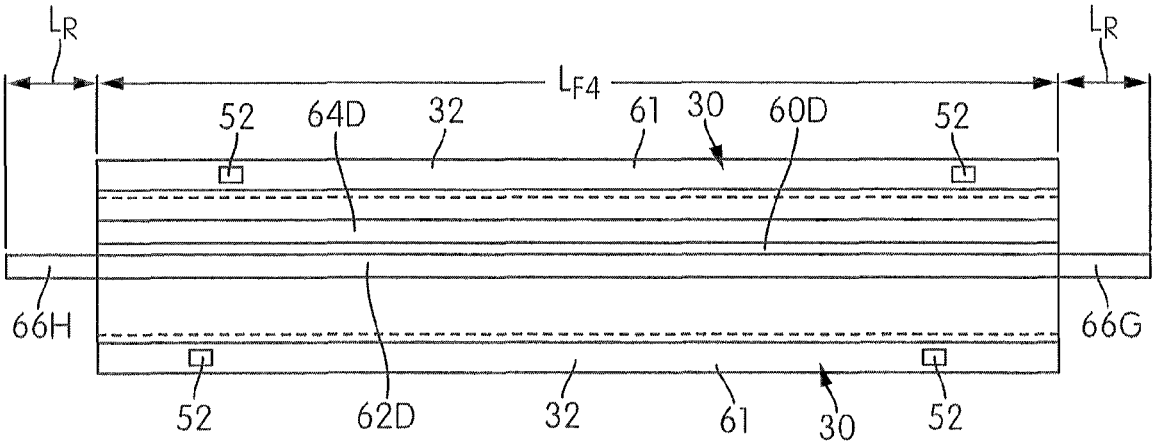
FIGS. 21-23 illustrate top, side, and end views of a fourth rail transition device of the system of FIG. 1B in accordance with one embodiment.
Figure 22:
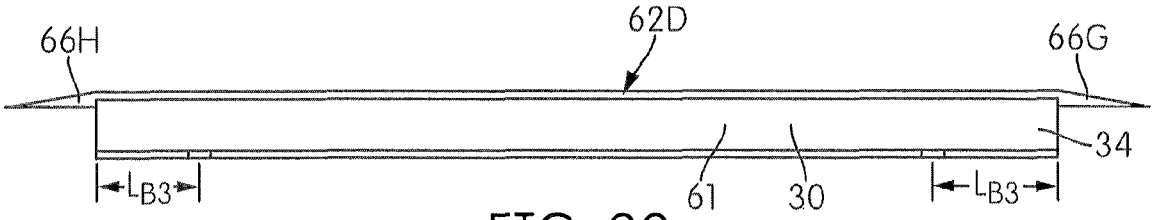

FIGS. 21-23 illustrate top, side, and end views of a fourth rail transition device 400 of the system 100, in accordance with one embodiment. Fourth rail transition device 400 comprises a body 60D with guide portion 62D and guard rail 64D positioned on a top of its longitudinal surface, as shown in FIG. 21. Body 60D has a longitudinal length LF4 of approximately 126 inches. Guide portion 62D is positioned at an angle relative to the elongated body portion 60D. Guide portion 62D has a first (e.g., front or entrance) and second (e.g., back or exit) ramps 66G and 66H each extending a length LR from the ends of the body 60D, each of which are configured for alignment with and placement on rails (e.g., first transition rail 14T1 of first curved rail 14A of turnout track 14 and second transition rail 14T2 of second curved rail 14B of turnout track 14, as shown in FIG. 1B). The length LR of the ramps 66G and 66H is approximately 12 inches. Each of the ramps 66G and 66H of the guide portion 62D is positioned at an angle relative to the elongated body portion 60D, and can vary as previously noted, in order guide wheels upon entry onto the elongated body portion 60D and exit therefrom. The space or flangeway 70 between the guide portion 62D and guard rail 64D is approximately 1½ inches.

Unlike the previously described rail transition devices 100, 200, and 300, in accordance with one embodiment, fourth rail transition device 400 has connected arm portions 61 rigidly fixed to the body portion 60D and that are used as the leg portions 30 on either of its sides. That is, there are no adjustment slots 36 in its leg portions and/or attachment bolts 38 provided in fourth rail transition device 400 (e.g., see FIG. 22), because the body portion 60D and leg portions 30 are connected directly together and form a single structure. Because the fourth rail transition device 400 is assembled relative to and in line with rail 14B of the turnout track 14, vertical adjustment of the body portion 60D to accommodate a height adjustment between existing rail heights (between approximately 5 41/64 inches and approximately 7 7/16 inches) is not necessarily required. For example, because an existing main track 12 may have varied rail dimensions and/or some vertical wear, e.g., due to its previous use, vertical adjustment capabilities on body portions 60A, 60B, and/or 60C can allow for adjustment relative to an existing main line track 12 to accommodate such dimensional variances. Device 400 does not necessarily require vertical adjustment because the rail (i.e., second curved rail 14B of turnout track 14) on which it is installed is substantially new and thus can be manufactured to accommodate the dimensions of the rail 14B in which it is aligned. The height of the rail 14B on which device 400 sits on does not need vary relative to the rail 14B on which it is installed.

In one embodiment, the body portion 60D and leg portions 30 are formed integrally together. In another embodiment, parts of the body portion 60D and/or leg portions 30 are manufactured and rigidly connected together (e.g., via welding or bonding) to form a single piece.

However, it should be noted that in accordance with another embodiment, fourth rail transition device 400 can be manufactured to at least vertical adjust, e.g., using similar configurations (e.g., separate leg portions 30 and arm portions 61, with adjustment slots 36 and bolts 38) as described above, and thus should not be limited. In one embodiment, it is envisioned that fourth, rail transition device 400 includes a body portion 60D and separate leg portions 30 that are aligned and secured together, such as shown in FIG. 14 or 18, for example.

Receiving openings 52 are also provided in leg portions 30 of fourth rail transition device 400 (e.g., see FIG. 21) to align with attachment brackets 28 and to connect the device to predetermined turnout ties. Since the dimensions related to openings 52 for fourth rail transition device 400 are substantially similar the previously described rail transition devices 100, 200, and 300, as shown, their description and alternatives are therefore are not repeated.

FIG. 23 shows an end view of device 400. Unlike devices 100, 200 and 300 device 400 does not require a stiffener because the underside of device 400 rests on top of the rail 14B. Thus, the rail 14B below device 400, when it is installed thereon, acts as the stiffener. Accordingly, placement and installment of the body portion 60D on the rail 14B allows the rail 14B to aid in reducing and/or eliminating warping along the overall length of the device.

Accordingly, the herein described rail transition system 100 provides rail transition devices (or leap frogs) that are configured for mounting over rails of a main track and part of an included transition track without application or bracing above the existing main track. Rather, the disclosed devices are positioned inside the cribs (between the ties). This allows for at least temporary of a turnout rail without potentially damaging the existing track. Thus, damage is substantially reduced and/or substantially eliminated when the disclosed system is installed. Additionally, installation of the herein disclosed system 100 does not require any type of modification (e.g., rails being cut) of the existing track (main track 12). Previous systems also require extensive installation of support structures (i.e. jacks) but this system 100 does not require an extensive support structure(s). Further, the system 100 can include customized rail transition devices based on the curve radius of the turnout rail desired. Each of the rail transition devices and the turnout ties can be assigned a predetermined installation location, so that the installation process is made easier. Moreover, the system 100 is provided as a packaged design that is configured for easier installation (and later removal) to an existing main track.

To install the parts of the portable and temporary rail transition system 100 described above to a main railroad track in order to provide a turnout track 14 for guiding rail equipment from parallel rails of the main track to parallel rails of a turnout track, a suitable place to install the portable turnout track is located. The parts of the rail transition system 100, e.g., turnout ties 18A-18L, rails 14A (14T1 and 14T2) and 14B of the turnout track 14, and rail transition devices 100-400 can be designed and manufactured based on the desired curve radius of the turnout track, for example.

The method for installation of the rail transition system 100 includes installing the plurality of turnout ties under the parallel rails of the main track. This may include first marking (manually) each turnout tie location along the main track 12 utilizing spacing specifications of printed instructions provided with the turnout ties. Optionally, the top of the rails can be marked to aid in aligning the ties during their installation. The turnout ties can be numerically ordered adjacent to their assigned spaces or locations for easier access.

Existing spikes and/or anchors on existing ties are removed so that the existing ties under the main track can be removed (e.g., using a backhoe). The holes are cleaned out for receipt of the assigned turnout tie. Once the noted existing ties are removed, the turnout ties are installed in place thereof. Starting with each tie, e.g., tie #1-tie 18A, tie #2-tie 18B, etc., the turnout tie is placed into the hole under the rails of the main track 12 and lined up with the marks made on the (top of the) rails of the main track 12. After each tie is in place and lined up (e.g., using optional alignment marks on the ties), the tie is nipped up and each of the twelve ties 18A-18L is secured.

Once all of the turnout ties are installed, the rails 14A and 14B of the turnout track 14 are set. Optionally, the rails 14A and 14B may be marked (e.g., with paint) to provide a code (e.g., color code) for placement and alignment with the turnout ties. Nonetheless, the process includes: installing the first curved rail 14A by positioning the first transition rail 14T1 between the parallel rails 12A and 12B of the main track 12 such that its first end 15 is adjacent to the first rail 12A of the main track and the second end 17 is adjacent to the second rail 12B of the main track 12. The second transition rail 14T2 is positioned adjacent to an outside of the second rail 12B of the main track and in longitudinal alignment with the second end 17 of the first transition rail 14T1. The first transition rail 14T1 and second transition rail 14T2 are positioned over the installed turnout ties 18A-18L.

Then, the method continues by installing the second curved rail 14B in parallel alignment with the first and second transition rails 14T1 and 14T2 of the first curved rail 14A adjacent to the outside of the second rail 12B of the main track 12. At least a portion of the turnout track 14 is attached to one or more of the installed turnout ties 18A-18L under the parallel rails of the main track 12 and turnout track 14. For example, as noted above, the rails 12A, 12B, 14A, and/or 14B can be seated within turnout plates 20 and/or attachment plates 22 provided on one or more of the installed turnout ties 18A-18L. Force may be required for insertion of a rail into its plate.

Once the rails are seated in the plates 20 and/or 22, the rails are clipped in place to the ties (e.g., using clips or fasteners or other mechanical devices, generally known in the art), as previously noted. Before clipping the rails 14A and 14B in place, the gap or clearance between the ends of rails of the turnout track 14 and sides of the rails of the main track 12 can be checked to ensure that the main track 12 can still be used. In an embodiment, the clearance between the rails is or should be at least approximately 5 inches.

After the rails 14A and 14B are installed and all rails 12A, 12B, 14A, and 14B are secured to their relative turnout ties 18A-18L, then each rail transition device is installed and attached to predetermined ties of the installed turnout ties. This can include placement on and/or attachment of the attachment brackets 28 to their predetermined turnout ties 18A-18L. Also, installation includes mounting the body portion 60 of each rail transition device over at least a portion of the turnout track such that the ramps 66 of the guide portion 62 are aligned with the rail, and removably connecting the leg portions 30 to the body portion 60 and to the predetermined ties of the installed turnout ties (if not already pre-connected). The horizontal portions 32 of each L-shaped bracket of each leg portion 30 is connected to one of the predetermined ties using attachment brackets 28. The extension portion 48 of each attachment bracket 28 is inserted through each receiving opening 52 on the horizontal portion 32, and each pin 54 is inserted through the slot 50 of the extension portion 48. Each attachment bracket 28 is attached via bolts 49 to its predetermined tie.

Each rail transition device 100, 200, 300, and 400 is capable of being removed and reinstalled using the pins 54 and attachment brackets 28. The attachment brackets 28 can be installed to a turnout tie by securing bolts 49 through openings 46 of the attachment brackets 28. The attachment brackets 28 can be bolted to ties before alignment with the body portion 60, or bolted to ties after the body portion 60 is connected to the alignment bracket 28 (e.g., placing the extension portions 48 through openings 52) to allow for movement and alignment of the rail transition devices before they are secured.

Installation may also include adjusting one or more rail transition devices in a vertical direction relative to the rails of the turnout track to a selected position, and securing or locking the adjusted rail transition devices in the selected position. If not already, the vertical portion 34 of each L-shaped bracket of each leg portion 30 is connected, or alternatively, further secured to the body portion 60 (e.g., after ramp alignment with the rail). Also, the elevation of the body portion can be adjusted in a vertical direction relative to the leg portions and the rails of the turnout track to a selected position using the adjustment slots 36, and locked (e.g., via nuts 40) in the selected position.

Again, color coding (or similar markings) can be used to ease installation of the rail transition devices. For example, the ramps 66 of each rail transition device 100, 200, 300, and 400 may be marked or colored with different markings/colorings to match locations on the installed turnout ties 18A-18L. The ramps of the guide portion 62 are aligned with the appropriate rail on the main track 12 and/or turnout track 14 such that the guard rail is positioned between the installed parallel rails of the turnout track.

It should be understood that any number of tools and equipment can be used to install the herein disclosed system as described above, including, but not limited to: a sledge hammer, a spike maul, a claw bar, a lining bar, a hydraulic impact, tape measure, backhoe, chain, spray paint or other marking medium (e.g., to mark areas or rails).

In addition to the features noted above, the herein disclosed portable and temporary system and its method of installation provides a low cost alternative to conventional turnout designs. The disclosed portable turnout system design allows for movement of rail equipment, e.g., switching of rolling stock, vehicles, or maintenance of way equipment) off a main line track or industrial lead at low speeds (e.g., equal to or less than approximately 10 mph) and requires no cutting or bending of the permanent main line track structure. It also is not installed over the rails of the main line, thereby substantially reducing and/or preventing damage and/or stress on the permanent main line rails. Further, electric and/or electronic equipment is not required to switch between use of the main track and the turnout track. Accordingly, equipment can move over, or leap over, the rails of the main line.

Further, the disclosed system provides the ability to install a turnout track in locations where there is not siding access. It is also more cost effective in that it reduces costs associated with installation (e.g., only a few workers or group is required for installation) and maintenance of the parts of the system.

The materials used form the parts of the system 10 are not meant to be limiting. In an embodiment, at least the ramps and guide portion are formed from steel, such as A36 steel. The materials and parts can be optionally heat treated and/or case hardened. Industry standards such as AISI Standard 1018 and 8620 and/or ASTM A108 may be used to form the parts of the rail transition devices 100, 200, 300, and 400, for example. Any of the parts of the rail transition devices (e.g., body portion 60) may be repaired or replaced if damaged.

While the principles of the disclosure have been made clear in the illustrative embodiments set forth above, it will be apparent to those skilled in the art that various modifications may be made to the structure, arrangement, proportion, elements, materials, and components used in the practice of the disclosure. For example, it is envisioned that the leg portions 30 and body portion 60 need not be limited to the shapes shown in the Figures. Also, for example, the body portion 60 may not be adjustable in height. In one embodiment, the body portion 60 and leg portions 30 are formed integrally together as a single piece.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A portable and temporary rail transition system for guiding rail equipment from parallel rails of a main track to parallel rails of a turnout track, the rail transition system comprising:

a plurality of turnout ties configured for positioning under the parallel rails of the main track and the parallel rails of the turnout track for replacing existing ties provided under the parallel rails of the main track;

the turnout track comprising first and second curved rails configured for positioning adjacent to the rails of the main track in parallel alignment;

the first curved rail comprising a first transition rail and a second transition rail, the first transition rail comprising a first end and a second end and that is configured for placement between the parallel rails of the main track such that the first end of the first transition rail is adjacent a first rail of the main track and the second end of the first transition rail adjacent a second rail of the main track;

the second transition rail configured for positioning adjacent to an outside of the second rail of the main track and in longitudinal alignment with the second end of the first transition rail; the second curved rail configured for positioning parallel to the first and second transition rails of the first curved rail adjacent to the outside of the second rail of the main track for curving away therefrom;

a first set of rail transition devices configured for mounting over the parallel rails of the main track and the parallel rails of the turnout track including the first end of the first transition rail and an end of the second curved rail adjacent to the outside of the second rail of the main track, the first set of rail transition devices configured to guide wheels of the rail equipment away from the parallel rails of the main track;

a second set of rail transition devices configured for positioning along the turnout track and spaced longitudinally relative to the first set of rail transition devices for mounting over the turnout track including the second end of the first transition rail and a portion of the second curved rail, the second set of rail transition devices configured to guide the wheels of the rail equipment onto the parallel rails of the turnout track;

wherein each rail transition device of each of the first and second sets is configured for attachment to the plurality of turnout ties when the turnout ties are positioned under the main and turnout tracks, and wherein each rail transition device comprises a guide portion with ramps, at least one of the ramps configured for alignment with a rail of the turnout track and configured to guide the wheels of the rail equipment towards and along the parallel rails of the turnout track.

2. The system according to claim 1, wherein the rail transition devices are configured for vertical adjustment relative to the rails of the turnout track.

3. The system according to claim 1, wherein each transition device further comprises a guard rail on each rail transition device that runs parallel to the guide portion of the rail transition device and configured for positioning between the parallel rails of the turnout track when attached, and wherein the guide portion and the guard rail have a space therebetween configured to at least partially receive the wheels of the rail equipment to guard from displacement of the wheels from the guide portion and towards the rails of the turnout track.

4. The system according to claim 1, wherein each rail transition device comprises a body portion and leg portions, wherein the body portion comprises a longitudinal surface with the guide portion provided thereon, the body portion configured for mounting over at least a portion of the turnout track such that the ramps of the guide portion are aligned with the rail of the turnout track, and wherein the leg portions are connected to the body portion and to the plurality of turnout ties.

5. The system according to claim 4, wherein the leg portions of at least one the rail transition devices comprise slots configured to enable vertical adjustment of the body portion relative to the leg portions and the rails of the turnout track.

6. The system according to claim 4, wherein each of the leg portions is an L-shaped bracket comprising a horizontal portion and a vertical portion, the vertical portion being substantially perpendicular to the horizontal portion, and wherein the horizontal portion is configured for connection to one of the plurality of turnout ties and the vertical portion is configured for connection to the body portion.

7. The system according to claim 4, further comprising attachment brackets configured to connect the leg portions to the turnout ties.

8. The system according to claim 7, wherein each attachment bracket comprises an extension portion with a slot, and wherein the horizontal portion of the leg portion has at least one receiving opening configured to receive the extension portion of the attachment bracket therethrough such that the slot can be used to secure the leg portion and the attachment bracket.

9. The system according to claim 8, further comprising a pin for each attachment bracket, and wherein each pin is configured for insertion through the slot of the extension portion of the attachment portion after receipt by the horizontal portion to secure the leg portion and the attachment bracket.

10. The system according to claim 1, wherein one or more of the rail transition devices further comprises a structure thereon configured for receipt of a device for moving the rail transition device relative to the track.

11. A method for installing a portable, temporary turnout system to a main railroad track for guiding rail equipment from parallel rails of the main track to parallel rails of a turnout track, the system comprising: a plurality of turnout ties configured for positioning under the parallel rails of the main track and the parallel rails of the turnout track, a turnout track comprising first and second curved rails configured for positioning adjacent to the rails of the main track in parallel alignment, the first curved rail comprising a first transition rail and a second transition rail, and a first set and a second set of rail transition devices, each rail transition device of the first and second sets being configured for attachment to the plurality of turnout ties when positioned under the main and turnout tracks and each rail transition device comprising a guide portion with ramps and a guard rail, at least one of the ramps of the guide portion configured for alignment with a rail of the turnout track and configured to guide wheels of the rail equipment towards and along the parallel rails of the turnout track and the guard rail running parallel to the guide portion and being spaced therefrom to at least partially receive wheels of the rail equipment to guard from displacement of the wheels from the guide portion and towards the parallel rails of the turnout track; the method comprising:

installing the plurality of turnout ties under the parallel rails of the main track;

installing the first curved rail by positioning the first transition rail between the parallel rails of the main track such that a first end of the first transition rail is adjacent a first rail of the main track and the second end of the first transition rail adjacent a second rail of the main track and by positioning the second transition rail adjacent to an outside of the second rail of the main track and in longitudinal alignment with the second end of the first transition rail, the first transition rail and second transition rail being positioned over the installed turnout ties;

installing the second curved rail in parallel alignment with the first and second transition rails of the first curved rail adjacent to the outside of the second rail of the main track for curving away therefrom;

attaching at least a portion of the turnout track to one or more of the installed turnout ties under the parallel rails of the main track and turnout track; and installing the rail transition devices of the first and second sets by attaching one or more of the rail transition devices to the installed turnout ties and aligning the at least one of the ramps of the guide portion with the rail of the turnout track such that the guard rail is positioned between the installed parallel rails of the turnout track.

12. The method according to claim 11, wherein the installing the rail transition devices comprises:

installing the first set of the rail transition devices over the first end of the first transition rail and an end of the second curved rail adjacent to the outside of the second rail of the main track, and installing the second set of the rail transition devices over the turnout track including the second end of the first transition rail and a portion of the second curved rail.

13. The method according to claim 12, further comprising:

adjusting in a vertical direction one or more of the rail transition devices relative to the rails of the turnout track to a selected position, and securing the adjusted rail transition devices in the selected position.

14. The method according to claim 11, wherein each rail transition device comprises a body portion and leg portions, wherein the body portion comprises a longitudinal surface with the guide portion provided thereon, and wherein the installing of the rail transition devices further comprises:

mounting the body portion over at least a portion of the turnout track such that the ramps of the guide portion are is aligned with the rail of the turnout track, and connecting the leg portions to the the installed turnout ties.

15. The method according to claim 14, wherein the leg portions of at least one of the rail transition devices comprise slots configured to enable vertical adjustment of the body portion relative to the leg portions and the rails of the turnout track, and wherein the method further comprises:

adjusting the body portion of the at least one rail transition device in a vertical direction relative to the leg portions and the rails of the turnout track to a selected position, and locking the adjusted body portion in the selected position.

16. The method according to claim 14, wherein each of the leg portions is an L-shaped bracket comprising a horizontal portion and a vertical portion, the vertical portion being substantially perpendicular to the horizontal portion, and wherein the connecting the leg portions to the installed turnout ties further comprises:

connecting the horizontal portion of each L-shaped bracket of each leg portion to one of the installed turnout ties.

17. The method according to claim 16, wherein the method further comprises: connecting the vertical portion of each L-shaped bracket of each leg portion to the body portion.

18. The method according to claim 16, further comprising attachment brackets configured to connect the leg portions to the installed turnout ties, each attachment bracket comprising an extension portion with a slot and wherein the horizontal portion of the leg portion has at least one receiving opening configured to receive the extension portion of the attachment bracket therethrough, and wherein the connecting the horizontal portion of each L-shaped bracket of each leg portion further comprises:

attaching the attachment bracket to one of the installed turnout ties;

aligning the extension portion with the receiving opening in the horizontal portion of the leg portion, and inserting the extension portion through the receiving opening, such that the slot can be used to secure the leg portion and the attachment bracket.

19. The method according to claim 18, wherein the system further comprises a pin for each attachment bracket, and wherein the method further comprises:

inserting the pin through the slot of the extension portion of the attachment portion after the inserting of the extension portion through the receiving opening of the horizontal portion.

20. The method according to claim 11, wherein the method further comprises: removing existing ties provided under the parallel rails of the main track before the installing the plurality of turnout ties under the parallel rails of the main track, the installed turnout ties being positioned in place of the removed existing ties under the parallel rails of the main track.

21. A portable and temporary rail transition system for guiding rail equipment from parallel rails of a main track to parallel rails of a turnout track, the rail transition system comprising:

a first set of rail transition devices configured for mounting over the parallel rails of the main track and the parallel rails of the turnout track, the first set of rail transition devices configured to guide wheels of the rail equipment away from the parallel rails of the main track;

a second set of rail transition devices configured for positioning along the turnout track and spaced longitudinally relative to the first set of rail transition devices for mounting over the turnout track, the second set of rail transition devices configured to guide the wheels of the rail equipment onto the parallel rails of the turnout track;

wherein each rail transition device comprises a guide portion with ramps, at least one of the ramps configured for alignment with a rail of the turnout track and configured to guide the wheels of the rail equipment towards and along the parallel rails of the turnout track, and wherein each rail transition device further comprises a guard rail on each rail transition device that runs parallel to the guide portion of the rail transition device.

22. The system according to claim 21, wherein the guide portion and the guard rail have a space therebetween configured to at least partially receive the wheels of the rail equipment to guard from displacement of the wheels from the guide portion and towards the rails of the turnout track.

23. The system according to claim 21, wherein the rail transition devices are configured for vertical adjustment relative to the rails of the turnout track.

24. The system according to claim 21, wherein at least one of the rail transition devices comprises a body portion and leg portions, wherein the body portion comprises a longitudinal surface with the guide portion provided thereon, the body portion configured for mounting over at least a portion of the turnout track such that the ramps of the guide portion are aligned with the rail of the turnout track, and wherein the leg portions are connected to the body.

25. The system according to claim 24, wherein the leg portions comprise slots configured to enable vertical adjustment of the body portion relative to the leg portions and the rails of the turnout track.

26. The system according to claim 24, wherein at least one of the leg portions is an L-shaped bracket comprising a horizontal portion and a vertical portion, the vertical portion being substantially perpendicular to the horizontal portion, and wherein the vertical portion is configured for connection to the body portion.

27. The system according to claim 24, further comprising attachment brackets configured to connect the leg portions to the turnout ties.

28. The system according to claim 27, wherein each attachment bracket comprises an extension portion with a slot, and wherein the horizontal portion of the leg portion has at least one receiving opening configured to receive the extension portion of the attachment bracket therethrough such that the slot can be used to secure the leg portion and the attachment bracket.

29. The system according to claim 28, further comprising a pin for each attachment bracket, and wherein each pin is configured for insertion through the slot of the extension portion of the attachment portion after receipt by the horizontal portion to secure the leg portion and the attachment bracket.

* * * * *